US009336785B2

(12) United States Patent
Thyssen et al.

(10) Patent No.: US 9,336,785 B2
(45) Date of Patent: May 10, 2016

(54) COMPRESSION FOR SPEECH INTELLIGIBILITY ENHANCEMENT

(75) Inventors: Jes Thyssen, Laguna Niguel, CA (US); Wilfrid LeBlanc, Vancouver (CA); Juin-Hwey Chen, Irvine, CA (US)

(73) Assignee: Broadcom Corporation, Irvine, CA (US)

( * ) Notice: Subject to any disclaimer, the term of this patent is extended or adjusted under 35 U.S.C. 154(b) by 1086 days.

(21) Appl. No.: 12/464,498

(22) Filed: May 12, 2009

(65) Prior Publication Data

US 2009/0281801 A1 Nov. 12, 2009

Related U.S. Application Data

(60) Provisional application No. 61/052,553, filed on May 12, 2008.

(51) Int. Cl.

| | |
|---|---|
| ***G10L 19/14*** | (2006.01) |
| ***G10L 19/012*** | (2013.01) |
| ***G10L 21/0208*** | (2013.01) |
| *G10L 21/0232* | (2013.01) |

(52) U.S. Cl.
CPC ..... *G10L 19/012* (2013.01); *G10L 21/0208* (2013.01); *G10L 21/0232* (2013.01)

(58) Field of Classification Search
CPC ..... H03G 3/32; H03G 9/025; H03G 9/18; H03G 7/00; G10L 21/0232
USPC ..... 704/500, 225; 381/106, 312
See application file for complete search history.

(56) References Cited

U.S. PATENT DOCUMENTS

| | | | | |
|---|---|---|---|---|
| 4,177,356 | A * | 12/1979 | Jaeger et al. | 381/103 |
| 4,182,993 | A * | 1/1980 | Tyler | 330/279 |
| 4,630,305 | A | 12/1986 | Borth et al. | |
| 4,736,433 | A * | 4/1988 | Dolby | 381/106 |
| 4,811,404 | A | 3/1989 | Vilmur et al. | |
| 5,278,912 | A * | 1/1994 | Waldhauer | 381/320 |
| 5,295,225 | A | 3/1994 | Kane et al. | |
| 5,463,695 | A * | 10/1995 | Werrbach | 381/106 |
| 5,467,393 | A | 11/1995 | Rasmusson | |
| 5,544,250 | A | 8/1996 | Urbanski | |
| 5,615,270 | A | 3/1997 | Miller et al. | |
| 5,666,429 | A | 9/1997 | Urbanski | |
| 5,706,352 | A | 1/1998 | Engebretson et al. | |
| 5,724,480 | A | 3/1998 | Yamaura | |
| 6,233,548 | B1 | 5/2001 | Schwartz et al. | |
| 6,275,596 | B1 * | 8/2001 | Fretz et al. | 381/321 |
| 6,418,408 | B1 | 7/2002 | Udaya Bhaskar et al. | |

(Continued)

OTHER PUBLICATIONS

U.S. Appl. No. 12/109,017, filed Apr. 24, 2008, Audio Signal Shaping for Playback by Audio Devices.

(Continued)

*Primary Examiner* — Douglas Godbold
*Assistant Examiner* — Mark Villena
(74) *Attorney, Agent, or Firm* — Fiala & Weaver P.L.L.C.

(57) ABSTRACT

A speech intelligibility enhancement (SIE) system and method is described that improves the intelligibility of a speech signal to be played back by an audio device when the audio device is located in an environment with loud acoustic background noise. In an embodiment, the audio device comprises a near-end telephony terminal and the speech signal comprises a speech signal received over a communication network from a far-end telephony terminal for playback at the near-end telephony terminal.

29 Claims, 24 Drawing Sheets

(56) References Cited

U.S. PATENT DOCUMENTS

| | | | | |
|---|---|---|---|---|
| 6,453,289 | B1 | 9/2002 | Ertem et al. | |
| 6,535,846 | B1 | 3/2003 | Shashoua | |
| 6,542,864 | B2 | 4/2003 | Cox et al. | |
| 6,735,567 | B2 | 5/2004 | Gao et al. | |
| 6,741,966 | B2 | 5/2004 | Romesburg | |
| 6,766,020 | B1 | 7/2004 | Tian et al. | |
| 6,810,273 | B1 | 10/2004 | Mattila et al. | |
| 6,848,012 | B2 | 1/2005 | LeBlanc et al. | |
| 6,928,495 | B2 | 8/2005 | LeBlanc et al. | |
| 6,931,373 | B1 | 8/2005 | Bhaskar et al. | |
| 6,959,275 | B2 | 10/2005 | Erell | |
| 6,993,480 | B1 | 1/2006 | Klayman | |
| 7,165,130 | B2 | 1/2007 | LeBlanc et al. | |
| 7,190,795 | B2 * | 3/2007 | Simon | 381/60 |
| 7,242,783 | B1 * | 7/2007 | Weeks et al. | 381/98 |
| 7,272,556 | B1 | 9/2007 | Aguilar et al. | |
| 7,283,585 | B2 | 10/2007 | LeBlanc et al. | |
| 7,283,956 | B2 | 10/2007 | Ashley et al. | |
| 7,333,475 | B2 | 2/2008 | LeBlanc et al. | |
| 7,409,056 | B2 | 8/2008 | LeBlanc et al. | |
| 7,457,757 | B1 * | 11/2008 | McNeill et al. | 704/500 |
| 7,464,029 | B2 | 12/2008 | Visser et al. | |
| 7,551,744 | B1 * | 6/2009 | Loftis et al. | 381/104 |
| 7,610,196 | B2 | 10/2009 | Nongpiur et al. | |
| 7,716,046 | B2 | 5/2010 | Nongpiur et al. | |
| 7,804,914 | B2 | 9/2010 | Nagatani et al. | |
| 7,903,825 | B1 * | 3/2011 | Melanson | 381/57 |
| 7,983,907 | B2 | 7/2011 | Visser et al. | |
| 7,995,975 | B2 | 8/2011 | Sundström | |
| 8,027,743 | B1 * | 9/2011 | Johnston | 700/94 |
| 8,090,576 | B2 | 1/2012 | Erell | |
| 8,107,643 | B2 | 1/2012 | Oh et al. | |
| 8,225,207 | B1 | 7/2012 | Ramirez | |
| 8,254,478 | B2 | 8/2012 | Hellberg | |
| 8,352,052 | B1 | 1/2013 | Green et al. | |
| 8,645,129 | B2 | 2/2014 | LeBlanc et al. | |
| 9,196,258 | B2 | 11/2015 | LeBlanc et al. | |
| 9,197,181 | B2 | 11/2015 | Thyssen et al. | |
| 2001/0002930 | A1 | 6/2001 | Kates | |
| 2001/0010704 | A1 | 8/2001 | Schelstraete | |
| 2002/0019733 | A1 * | 2/2002 | Erell | 704/225 |
| 2002/0114474 | A1 | 8/2002 | Finn | |
| 2002/0133356 | A1 * | 9/2002 | Romesburg | 704/500 |
| 2002/0172378 | A1 | 11/2002 | Bizjak | |
| 2002/0191799 | A1 | 12/2002 | Nordqvist et al. | |
| 2003/0004710 | A1 | 1/2003 | Gao | |
| 2003/0055635 | A1 | 3/2003 | Bizjak | |
| 2003/0059034 | A1 | 3/2003 | Etter | |
| 2003/0081804 | A1 | 5/2003 | Kates | |
| 2003/0088408 | A1 | 5/2003 | Thyssen et al. | |
| 2003/0112088 | A1 * | 6/2003 | Bizjak | 333/14 |
| 2003/0130839 | A1 | 7/2003 | Beaucoup et al. | |
| 2003/0135364 | A1 * | 7/2003 | Chandran et al. | 704/226 |
| 2004/0002313 | A1 * | 1/2004 | Peace et al. | 455/234.1 |
| 2004/0022400 | A1 * | 2/2004 | Magrath | 381/106 |
| 2004/0024591 | A1 | 2/2004 | Boillot et al. | |
| 2004/0037440 | A1 | 2/2004 | Croft, III | |
| 2004/0057586 | A1 * | 3/2004 | Licht | 381/94.7 |
| 2004/0148166 | A1 | 7/2004 | Zheng | |
| 2004/0151303 | A1 | 8/2004 | Park et al. | |
| 2004/0153317 | A1 | 8/2004 | Chamberlain | |
| 2004/0196994 | A1 | 10/2004 | Kates | |
| 2004/0213420 | A1 | 10/2004 | Gundry et al. | |
| 2004/0252850 | A1 * | 12/2004 | Turicchia et al. | 381/94.2 |
| 2005/0004796 | A1 | 1/2005 | Trump et al. | |
| 2005/0027520 | A1 | 2/2005 | Mattila et al. | |
| 2005/0111683 | A1 | 5/2005 | Chabries et al. | |
| 2005/0114127 | A1 | 5/2005 | Rankovic | |
| 2005/0147262 | A1 * | 7/2005 | Breebaart | 381/106 |
| 2005/0249272 | A1 | 11/2005 | Kirkeby et al. | |
| 2006/0133358 | A1 | 6/2006 | Li et al. | |
| 2006/0149532 | A1 | 7/2006 | Boillot et al. | |
| 2006/0182287 | A1 * | 8/2006 | Schulein et al. | 381/74 |
| 2006/0256980 | A1 * | 11/2006 | Pritchard | 381/104 |
| 2006/0270467 | A1 | 11/2006 | Song et al. | |
| 2006/0271354 | A1 | 11/2006 | Sun et al. | |
| 2006/0271358 | A1 | 11/2006 | Erell | |
| 2006/0293882 | A1 | 12/2006 | Giesbrecht et al. | |
| 2007/0019803 | A1 | 1/2007 | Merks et al. | |
| 2007/0021958 | A1 | 1/2007 | Visser et al. | |
| 2007/0100614 | A1 * | 5/2007 | Yoshida et al. | 704/223 |
| 2007/0136050 | A1 | 6/2007 | Tourwe | |
| 2007/0140513 | A1 | 6/2007 | Furge | |
| 2007/0150264 | A1 | 6/2007 | Tackin et al. | |
| 2007/0156395 | A1 | 7/2007 | Ojala | |
| 2007/0192088 | A1 | 8/2007 | Oh et al. | |
| 2007/0195975 | A1 * | 8/2007 | Cotton et al. | 381/104 |
| 2007/0237334 | A1 | 10/2007 | Willins et al. | |
| 2007/0254592 | A1 | 11/2007 | McCallister et al. | |
| 2007/0263891 | A1 | 11/2007 | Von Buol et al. | |
| 2008/0004869 | A1 | 1/2008 | Herre et al. | |
| 2008/0137872 | A1 | 6/2008 | Croft | |
| 2008/0159422 | A1 | 7/2008 | Chen et al. | |
| 2008/0189116 | A1 | 8/2008 | LeBlanc et al. | |
| 2008/0212799 | A1 * | 9/2008 | Breitschadel | 381/106 |
| 2008/0232612 | A1 | 9/2008 | Tourwe | |
| 2008/0240467 | A1 | 10/2008 | Oliver | |
| 2008/0269926 | A1 * | 10/2008 | Xiang et al. | 700/94 |
| 2009/0006096 | A1 | 1/2009 | Li et al. | |
| 2009/0063142 | A1 | 3/2009 | Sukkar | |
| 2009/0080675 | A1 | 3/2009 | Smirnov et al. | |
| 2009/0116664 | A1 | 5/2009 | Smirnov et al. | |
| 2009/0132248 | A1 | 5/2009 | Nongpiur | |
| 2009/0181628 | A1 | 7/2009 | Feder et al. | |
| 2009/0271186 | A1 | 10/2009 | LeBlanc et al. | |
| 2009/0281800 | A1 | 11/2009 | LeBlanc et al. | |
| 2009/0281803 | A1 | 11/2009 | Chen et al. | |
| 2009/0281805 | A1 | 11/2009 | LeBlanc et al. | |
| 2009/0287496 | A1 | 11/2009 | Thyssen et al. | |
| 2012/0209601 | A1 | 8/2012 | Jing | |
| 2013/0035934 | A1 | 2/2013 | Nongpiur | |
| 2014/0188466 | A1 | 7/2014 | Leblanc et al. | |
| 2015/0215467 | A1 | 7/2015 | Shue et al. | |

OTHER PUBLICATIONS

Boillot et al., "A Loudness Enhancement Technique for Speech", IEEE, ICASS, 2004, pp. v616-v619.

Sauert et al., "Near End Listening Enhancement: Speech Intelligibility Improvement in Noisy Environments", IEEE, ICASSP, 2006, pp. 493-496.

Westerlund et al., "Speech Enhancement for Personal Communication Using an Adaptive Gain Equalizer", Signal Processing, vol. 85 , Jan. 5, 2005, pp. 1089-1101.

Chen et al., "Adaptive Postfiltering for Quality Enhancement of Coded Speech", IEEE, Trans. on Speech and Audio Processing, vol. 3, No. 1, Jan. 1995, pp. 59-71.

Droney et al., "Compression Applications", TC Electronic, 2001, 10 pages.

"Automatic Gain Control", Wikipedia, webpage available at: <http://web.archive.org/web/20071103162745/http://en.wikipedia.org/wiki/Automaticgain__control>, retrieved on Apr. 18, 2013, 3 pages.

* cited by examiner

500

COMPRESSION FOR SPEECH INTELLIGIBILITY ENHANCEMENT

CROSS-REFERENCE TO RELATED APPLICATIONS

This application claims priority to U.S. Provisional Patent Application No. 61/052,553, filed May 12, 2008, the entirety of which is incorporated by reference herein.

BACKGROUND OF THE INVENTION

1. Field of the Invention

The present invention generally relates to communication systems used to transmit speech signals. More particularly, the present invention relates to methods for enhancing the intelligibility of speech signals received over a communication network from a far-end telephony terminal for playback at a near-end telephony terminal.

2. Background

Various background concepts will now be discussed in reference to an example conventional communication system 100 shown in FIG. 1. Communication system 100 includes a first telephony terminal 102 and a second telephony terminal 104 that are communicatively connected to each other via one or more communication network(s) 106. For the purposes of this example, first telephony terminal 102 will be referred to as the "near end" of the network connection and second telephony terminal 104 will be referred to as the "far end" of the network connection. Each telephony terminal may comprise a telephony device, such as a corded telephone, cordless telephone, cellular telephone or Bluetooth® headset.

First telephony terminal 102 operates in a well-known manner to pick up speech signals representing the voice of a near-end user 108 via a microphone 114 and to transmit such speech signals over network(s) 106 to second telephony terminal 104. Second telephony terminal 104 operates in a well-known manner to play back the received speech signals to a far-end user 110 via a loudspeaker 118. Conversely, second telephony terminal 104 operates in a well-known manner to pick up speech signals representing the voice of far-end user 110 via a microphone 116 and to transmit such speech signals over network(s) 106 to first telephony terminal 102. First telephony terminal 102 operates in a well-known manner to play back the received speech signals to near-end user 108 via a loudspeaker 112.

As further shown in FIG. 1, near-end user 108 is using first telephony terminal 102 in an environment that is subject to acoustic background noise. When this acoustic background noise becomes too loud, near-end user 108 may find the voice of far-end user 110 difficult to understand. This is because such loud acoustic background noise will tend to mask or drown out the voice of far-end user 110 that is being played back through loudspeaker 112 of first telephony terminal 102. When this occurs, the natural response of near-end user 108 may be to adjust the volume of loudspeaker 112 (assuming that first telephony terminal 102 includes a volume control button or some other volume control means) so that the volume of the voice of far-end user 110 is increased. However, it is inconvenient for near-end user 108 to have to manually adjust the volume in this manner; it would be far more convenient if first telephony terminal 102 could automatically adjust the volume to the appropriate level in response to an increase in acoustic background noise.

Furthermore, although near-end user 108 may increase the volume of loudspeaker 112, there is typically a limit on how much amplification can be applied to the speech signal received from far-end user 110 before that signal is subject to digital saturation or clipping. Additionally, even when the speech signal received from far-end user 110 has been amplified to a level immediately below which clipping occurs or to a level at which slight clipping occurs, the speech signal may still not be loud enough to be intelligible over the acoustic background noise.

Various techniques have been described in the literature that can be used to increase the loudness of a speech signal subject to a magnitude limit (such as amplitude compression) or to make the speech signal more intelligible. However, many of these techniques distort the speech signal.

What is needed, therefore, is a speech intelligibility enhancement (SIE) system and method that improves the intelligibility of a speech signal received over a communication network from a far-end telephony terminal for playback at a near-end telephony terminal when the near-end terminal is located in an environment with loud acoustic background noise. The desired SIE system and method should function automatically without any user input and also achieve improved intelligibility while minimizing distortion to the received speech signal.

BRIEF SUMMARY OF THE INVENTION

A speech intelligibility enhancement (SIE) system and method is described herein that may be used to improve the intelligibility of a speech signal to be played back by an audio device when the audio device is located in an environment with loud acoustic background noise. In an embodiment, the audio device comprises a near-end telephony terminal and the speech signal comprises a speech signal received over a communication network from a far-end telephony terminal for playback at the near-end telephony terminal.

In particular, a method for processing a portion of a speech signal to be played back by an audio device is described herein. In accordance with the method, a reference amplitude associated with the portion of the speech signal is calculated. A first gain to be applied to the portion of the speech signal is received. Compression is then applied to the portion of the speech signal if application of the first gain to the portion of the speech signal would cause the reference amplitude associated with the portion of the speech signal to exceed a predetermined amplitude limit.

A system for processing a portion of a speech signal to be played back by an audio device is also described herein. The system includes a waveform envelope tracker and compression logic. The waveform envelope tracker is configured to calculate a reference amplitude associated with the portion of the speech signal. The compression logic is configured to receive a first gain to be applied to the portion of the speech signal and to apply compression to the portion of the speech signal if application of the first gain to the portion of the speech signal would cause the reference amplitude associated with the portion of the speech signal to exceed a predetermined amplitude limit.

A computer program product is also described herein. The computer program product comprising a computer-readable medium having computer program logic recorded thereon for enabling a processing unit to process a portion of a speech signal to be played back by an audio device. The computer program logic includes first means, second means and third means. The first means are for enabling the processing unit to calculate a reference amplitude associated with the portion of the speech signal. The second means are for enabling the processing unit to receive a first gain to be applied to the portion of the speech signal. The third means are for enabling the processing unit to apply compression to the portion of the speech signal if application of the first gain to the portion of the speech signal would cause the reference amplitude associated with the portion of the speech signal to exceed a predetermined amplitude limit.

Further features and advantages of the invention, as well as the structure and operation of various embodiments of the invention, are described in detail below with reference to the accompanying drawings. It is noted that the invention is not limited to the specific embodiments described herein. Such embodiments are presented herein for illustrative purposes only. Additional embodiments will be apparent to persons skilled in the relevant art(s) based on the teachings contained herein.

BRIEF DESCRIPTION OF THE DRAWINGS/FIGURES

The accompanying drawings, which are incorporated herein and form part of the specification, illustrate the present invention and, together with the description, further serve to explain the principles of the invention and to enable a person skilled in the relevant art(s) to make and use the invention.

Figure 1:
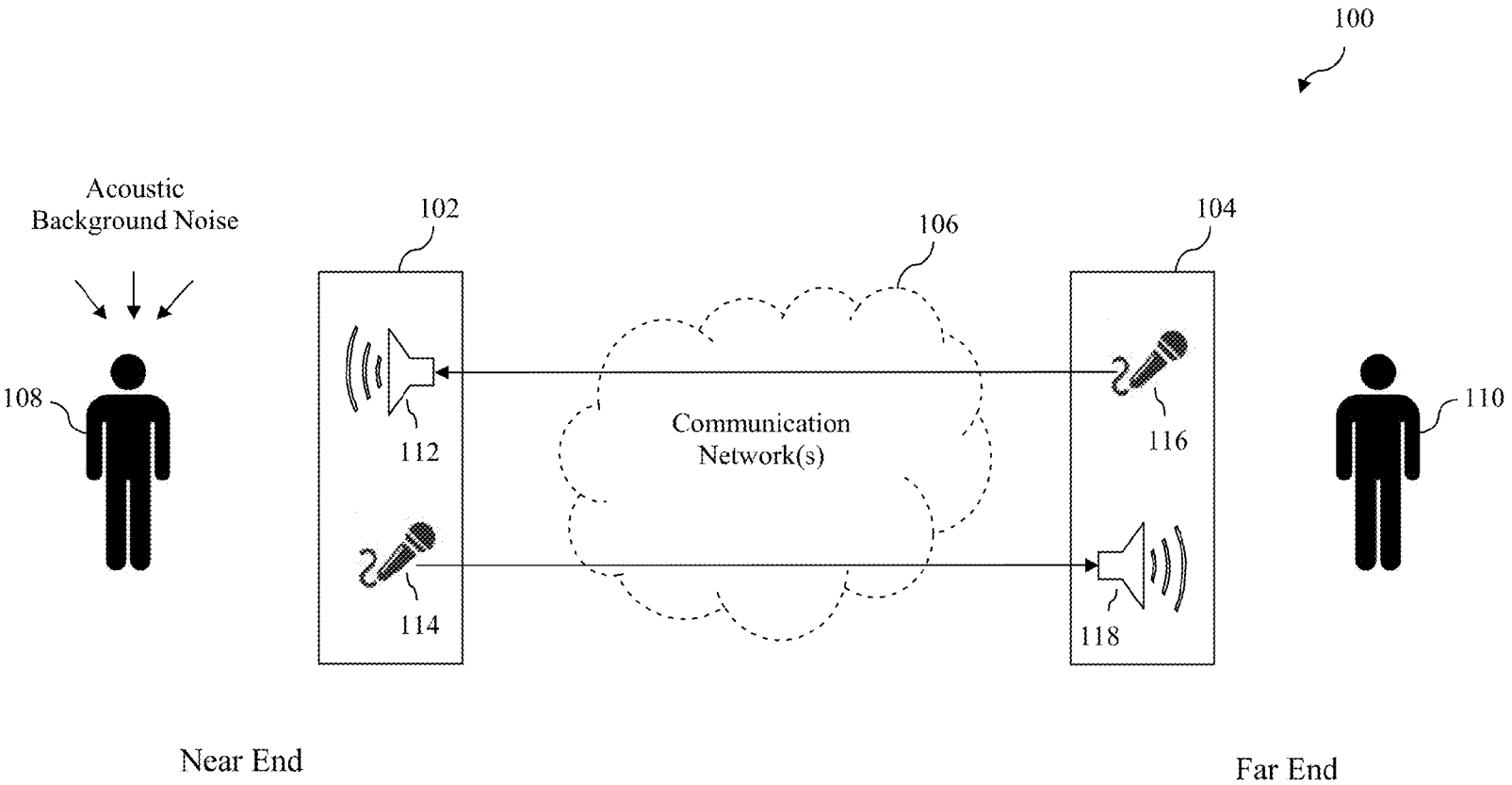
FIG. 1 (Prior Art)
FIG. 1 is a block diagram of an example conventional communication system.

The features and advantages of the present invention will become more apparent from the detailed description set forth below when taken in conjunction with the drawings, in which like reference characters identify corresponding elements throughout. In the drawings, like reference numbers generally indicate identical, functionally similar, and/or structurally similar elements. The drawing in which an element first appears is indicated by the leftmost digit(s) in the corresponding reference number.

DETAILED DESCRIPTION OF THE INVENTION

A. Introduction

The following detailed description refers to the accompanying drawings that illustrate exemplary embodiments of the present invention. However, the scope of the present invention is not limited to these embodiments, but is instead defined by the appended claims. Thus, embodiments beyond those shown in the accompanying drawings, such as modified versions of the illustrated embodiments, may nevertheless be encompassed by the present invention.

References in the specification to "one embodiment," "an embodiment," "an example embodiment," or the like, indicate that the embodiment described may include a particular feature, structure, or characteristic, but every embodiment may not necessarily include the particular feature, structure, or characteristic. Moreover, such phrases are not necessarily referring to the same embodiment. Furthermore, when a particular feature, structure, or characteristic is described in connection with an embodiment, it is submitted that it is within the knowledge of persons skilled in the relevant art(s) to implement such feature, structure, or characteristic in connection with other embodiments whether or not explicitly described.

A speech intelligibility enhancement (SIE) system and method is described herein that can be used to improve the intelligibility of a speech signal received over a communication network from a far-end telephony terminal for playback at a near-end telephony terminal. The SIE system and method is particularly useful in a scenario in which a user of the near-end telephony terminal attempts to conduct a telephone call in an environment with loud acoustic background noise, as described in the Background Section above. Generally speaking, the SIE system and method, which may be implemented as part of the near-end telephony terminal, monitors both the speech signal received from the far-end telephony terminal and a near-end background noise signal and, based on both signals, modifies the speech signal to increase the intelligibility while minimizing the distortion thereof.

In one embodiment, the SIE system and method increases intelligibility by maintaining a desired minimum signal-to-noise ratio (SNR) between the speech signal being played back on a loudspeaker of the near-end telephony terminal and the ambient background noise. The minimum SNR is determined such that the speech remains intelligible in the presence of the ambient background noise.

In a further embodiment, the SIE system and method is configured to attain the minimum SNR by applying a pure linear gain to the speech signal received from the far-end telephony terminal. However, should digital saturation of the output waveform be reached before the minimum SNR has been reached, then the SIE system and method performs amplitude compression to allow greater subsequent amplification of lower level segments of the received speech signal.

In accordance with a particular implementation of the SIE system and method, the performance of amplitude compression followed by amplification is carried out in such a manner that digital saturation is impossible. Thus, the system and method is guaranteed never to saturate and cause clipping of the speech output signal. As will be described in more detail herein, this is achieved in part by using a frame-by-frame instant attack approach to tracking the waveform envelope of the received speech signal and then using information derived from such waveform envelope tracking to limit the amount of gain that may ultimately be applied to the received speech signal.

In a still further embodiment, the SIE system and method monitors the degree of amplitude compression and uses this information as an input (in a feedback manner) to control an amount of spectral shaping that is applied to the received speech signal. If no amplitude compression is applied, then no spectral shaping is applied since the minimum SNR was attained without amplitude compression. However, if amplitude compression is applied, then this indicates that there was not enough digital "headroom" to attain the minimum SNR through the application of a simple linear gain. The application of amplitude compression allows for further increases in loudness, but at some point this technique is also not sufficient to ensure intelligibility. Hence, at a certain point spectral shaping is enabled based on the amount of amplitude compression. The amount of amplitude compression can also be thought of as the amount of linear gain that had to be discarded (on the highest amplitudes), but was required to reach the minimum SNR. Viewed this way, the amount of amplitude compression provides a good indicator of the remaining shortage of intelligibility, which must be provided using different means in order to reach the minimum SNR for intelligibility. Hence, in accordance with this embodiment, the amount of spectral shaping applied is a function of at least the amount of amplitude compression that was applied.

In an alternative embodiment, the amount of spectral shaping applied is a function of the amount of digital headroom (or lack thereof) between the signal level required to achieve the minimum SNR and the digital saturation point or some other point at which amplitude compression will be applied. Note that in additional embodiments, spectral shaping may be applied to the received speech signal in a manner that is not dependent on feedback concerning the degree of amplitude compression or the amount of digital headroom available.

The example SIE system and methods described herein may advantageously be implemented in a wide variety of telephony terminals including but not limited to, corded telephones, cordless telephones, cellular telephones, Bluetooth® headsets, or any other telephony terminals configured to pick up and transmit speech signals representative of the voice of a near-end user to a far-end user and to receive and play back speech signals representative of the voice of the far-end user to the near-end user.

Figure 2:
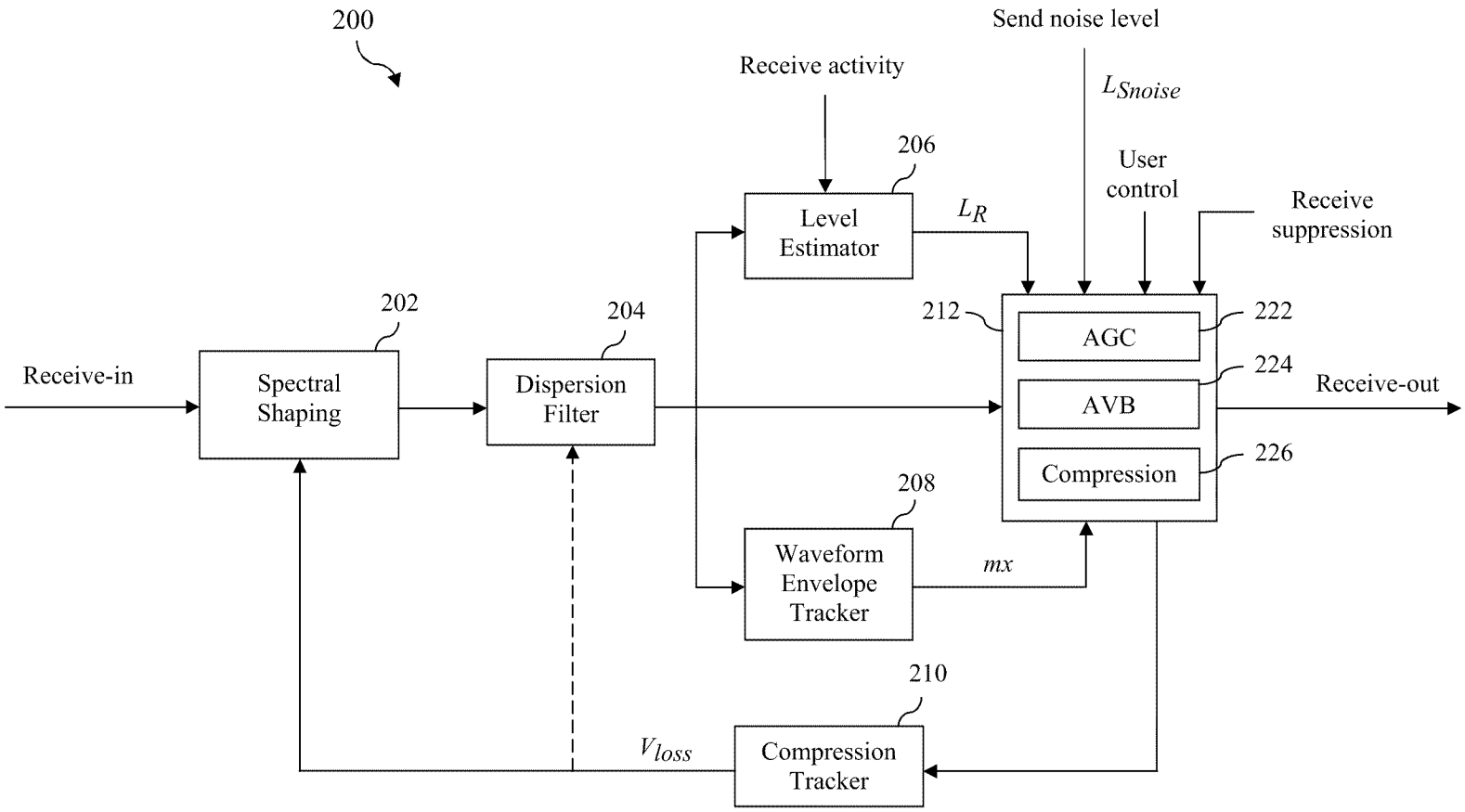
FIG. 2 is a block diagram of an example speech intelligibility enhancement (SIE) system in accordance with an embodiment of the present invention.

B. Speech Intelligibility Enhancement System in Accordance with an Embodiment of the Present Invention FIG. 2 is a block diagram of an example SIE system 200 in accordance with one embodiment of the present invention. As shown in FIG. 2, SIE system 200 includes a spectral shaping block 202, a dispersion filter 204, a level estimator 206, a waveform envelope tracker 208, a compression tracker 210, and an Automatic Gain Control (AGC)/Automatic Volume Boosting (AVB)/compression block 212. AGC/AVB/compression block 212 includes AGC logic 222, AVB logic 224, and compression logic 226.

Generally speaking, the components of example SIE system 200 operate together to improve the intelligibility of a speech signal received over a communication network from a far-end telephony terminal (referred to herein as the "far-end speech signal") for playback by a near-end telephony terminal of which SIE system 200 is a part. In FIG. 2, the far-end speech signal is denoted "Receive-in." This signal may be received from another component in the telephony terminal. For example, the far-end speech signal may be received from a buffer that stores digital samples produced by an audio decoder within the telephony terminal. The audio decoder in turn may produce the digital samples by decoding an encoded bit stream transported over a communication network. The output of SIE system 200 is the modified far-end speech signal, denoted "Receive-out" in FIG. 2, which is provided directly or indirectly to a loudspeaker for playback to a user.

Certain components of system 200 will now be briefly described and additional details about each component will be provided in the sub-sections below.

AGC logic 222 is configured to compensate for variations in the level of the far-end speech signal. For example, such variations may be due to variation of network connections, acoustic coupling, or the like. AGC logic 222 calculates a gain scaling factor that, when applied to the far-end speech signal, brings the far-end speech signal to a nominal signal level.

AVB logic 224 is configured to automatically boost the level of the far-end speech signal to maintain at least a minimum SNR as the level of near-end background noise increases. In particular, AVB logic 224 is configured to maintain at least a predetermined minimum far-end speech signal to near-end noise ratio by calculating an additional gain to be applied to the far-end speech signal if the level of the near-end background noise is such that the level of the far-end speech signal after AGC yields an SNR below the predetermined minimum SNR.

Level estimator 206 is configured to determine an estimated level of the far-end speech signal and to provide this information to AGC logic 222 and AVB logic 224 for use in performing gain calculations.

Compression logic 226 is configured to apply a time-varying gain to the far-end speech signal that allows for application of the full AVB gain to attain the desired minimum SNR without digital saturation or clipping of the output signal. In determining the time varying gain, compression logic 226 takes into account all the gains to be applied to the far-end speech signal before playback (for example, user volume gain, echo suppression gain, or the like). In one implementation, a single gain is applied to the far-end speech signal to achieve the intended effect while in an alternate implementation a separate gain is applied by each of AGC logic 222, AVB logic 224 and compression logic 226 in order to achieve the intended effect.

Generally speaking, compression logic 226 operates by applying more attenuation to larger waveform peaks than to lower peaks. Effectively, compression logic 226 boosts the low-amplitude regions of the far-end speech signal when AVB logic 224 cannot maintain the intelligibility of the far-end speech signal without causing saturation. In particular, compression logic 226 applies smaller gains to the high-amplitude regions of the far-end speech signal and larger gains to the low-amplitude regions. This has the effect of compressing the high-amplitude regions relative to the low-amplitude regions, thus the name. Such amplitude compression may be simply referred to as "compression" elsewhere in this document as shorthand. In effect, compression logic 226 amplifies the low-amplitude regions relative to the high-amplitude regions without exceeding the digital saturation level, and therefore has the effect of increasing the loudness of the far-end speech signal without introducing digital saturation.

Waveform envelope tracker 208 is configured to perform waveform envelope tracking on the far-end speech signal and to provide waveform tracking information to AGC/AVB/compressor block 212 that can be used by that block to determine exactly how much headroom there is to digital saturation in the far-end speech signal prior to modifying it.

Dispersion filter 204 is configured to reduce a peak-to-average ratio of the waveform samples of the far-end speech signal so that the filtered speech signal has smaller peak values and thus allows more headroom for AVB logic 224 to boost the far-end speech signal without introducing digital saturation. In an exemplary embodiment of the present invention, dispersion filtering is achieved using an all-pass filter. Such an all-pass filter can be either fixed or adaptive. A fixed all-pass filter is lower in complexity but can achieve only a smaller reduction of the magnitude peak of the far-end speech. Conversely, an adaptive all-pass filter has higher complexity but also has the potential to achieve a larger reduction of the magnitude peak.

Spectral shaping block 202 is configured to boost certain local peaks of the spectral envelope (called "formants") of the far-end speech signal above the near-end noise floor to make the far-end speech signal more intelligible. In particular, spectral shaping block 202 is configured to boost certain formants of the far-end speech signal above the spectral values of the near-end noise at corresponding frequencies. In trying to understand spoken speech, humans normally rely on recognizing the frequencies of the speech formants. Therefore, by boosting certain formants of the far-end speech signal above the noise floor, spectral shaping block 202 makes the far-end speech more intelligible. In one embodiment, the second and third formants of the far-end speech signal are boosted relative to the first formant since the second and third formants are more important from the perspective of speech intelligibility than the first formant.

In one exemplary embodiment of the present invention, spectral shaping is implemented by adaptive high-pass filtering. For example, such adaptive high-pass filtering may be used to boost the second and third formants of the far-end speech signal relative to the first formant, since the second and third formants are located at higher frequencies than the first formant. The degree of high-pass filtering may depend on the far-end speech as well as the near-end noise. The high-pass filter may consist of a single-stage filter or multiple stages of filters, where different stages have different adaptation characteristics. For example, the high-pass filter may contain two stages of high-pass filters, with a slowly-evolving first stage having a long adaptation time constant and a rapidly-evolving second stage having a relatively short adaptation time constant.

In accordance with one implementation of SIE system 200, the signal processing techniques performed by AGC logic 222, AVB logic 224, compression logic 226, dispersion filter 204 and spectral shaping block 202 are applied one-by-one in a specific sequence so as to minimize the distortion introduced to the far-end speech signal, with each new technique being applied only when necessary. For example, AGC may first be applied by AGC logic 222 to bring the far-end speech to a nominal level. If the background noise level is low, AGC may be the only technique applied. As the background noise level increases, AVB may be applied by AVB logic 224 to increase the volume of the far-end speech signal. As the background noise level increases further, compression may then be applied by compression logic 226 to further boost the low-amplitude regions of the far-end speech signal if AVB is not sufficient to maintain the intelligibility of the far-end speech signal. As the background noise level increases even further, dispersion filtering can be applied by dispersion filter 204 to reduce the peak-to-average ratio of the far-end speech signal, thereby providing additional headroom for performing AVB. If the background noise is so loud that the above four techniques are not sufficient, spectral shaping can then be applied by spectral shaping block 202 to further enhance the speech intelligibility by exploiting the properties of human perception.

With further reference to the foregoing example implementation, AGC and AVB are applied first since those techniques hardly introduce any distortion to the far-end speech signal. Compression however can make speech sound slightly unnatural due to the compression of natural dynamic range, and dispersion filtering may introduce a slight distortion to the speech; therefore, these two techniques are applied only when AGC and AVB alone cannot provide sufficient intelligibility of the far-end speech signal. Finally, depending on the telephony terminal, spectral shaping may make the most dramatic and audible modification of the far-end speech signal and thus this technique is only applied when the above four techniques do not provide sufficient intelligibility of the far-end speech.

In alternate implementations, exceptions to this approach may be made. For example, in certain embodiments techniques that increase distortion in a traditional sense are applied before the amount of linear gain that may be applied without reaching digital saturation has been exhausted. One example of such an embodiment is an embodiment that limits high waveform amplitudes below a maximum digital amplitude to protect the auditory system of a user from exposure to uncomfortable, or possibly, damaging signal levels.

Each of the foregoing components of system 200 and the manner in which such components operate to implement aspects of the present invention will now be described. In the following description, it is assumed that the speech signal being processed comprises a series of digital samples and that the series of digital samples is divided into discrete time segments termed frames. In the description, individual frames are referred to by a frame counter, wherein a frame counter k generally refers to the frame currently being processed and frame counter k−1 refers to the immediately previous frame.

It should be understood that while most of the algorithm parameters given below are specified assuming a sampling rate of 8 kHz for telephone-bandwidth speech, persons skilled in the relevant art(s) should have no problem extending the techniques presented below to other sampling rates, such as 16 kHz for wideband speech. Therefore, the parameters specified are only meant to be exemplary values and are not limiting.

1. Spectral Shaping Block 202

In SIE system 200, spectral shaping block 202 is configured to receive the far-end speech signal (shown as "Receive-in" in FIG. 2) and to apply spectral shaping thereto in a manner that is controlled by feedback from compression tracker 210. As will be described in more detail below, such spectral shaping may include both slowly-evolving and rapidly-evolving spectral shaping filters, wherein the combination offers the advantage of not having to drive either filter too hard.

Spectral shaping block 202 is configured to boost certain formants of the far-end speech signal above the near-end noise floor so that they can be recognized by the near-end telephony terminal user and thus help that user understand the speech. Since the far-end speech signal is changing with time, such spectral shaping is preferably adaptive in order to increase effectiveness. Also, to avoid introducing distortion, such spectral shaping is preferably evolved in a smooth manner.

One possible manner of performing such spectral shaping is to perform spectral analysis followed by synthesis. This may be accomplished by using a Fast Fourier Transform (FFT) and inverse FFT, or using sub-band analysis and sub-band synthesis. For example, with FFT or sub-band analysis of both the far-end speech and the near-end noise, a determination can be made as to whether the formants of the far-end speech signal are below the noise floor. If so, those spectral components of the far end speech signal around the formants are boosted (i.e., a gain is applied) such that they are at least Y dB above the noise floor, where Y is determined and tuned empirically. Then, the modified frequency-domain representation of the far-end speech is converted back to a time domain signal.

Although the foregoing method allows for precise control of the SNR at each formant frequency, one drawback of the method is that it requires significant complexity. In an exemplary embodiment of the present invention, the spectral shaping is achieved with very-low-complexity time-domain filtering using a low-order high-pass filter. The use of such a high-pass filter achieves two goals. First, it helps to boost the second and third formants of the far-end speech signal. The second and third formants are more critical to speech intelligibility and are often much lower in intensity as compared with the first formant and thus are frequently buried under the noise floor when in a noisy environment. Second, it attenuates the first formant around or below 500 Hz, which normally dominates the energy content of the voiced speech signal and which often overloads the tiny loudspeakers used in many telephony devices. By attenuating the first formant relative to the second and third formants, the high-pass filter allows more energy that is useful for intelligibility to be emitted from such tiny loudspeakers before overloading them.

Figure 3:
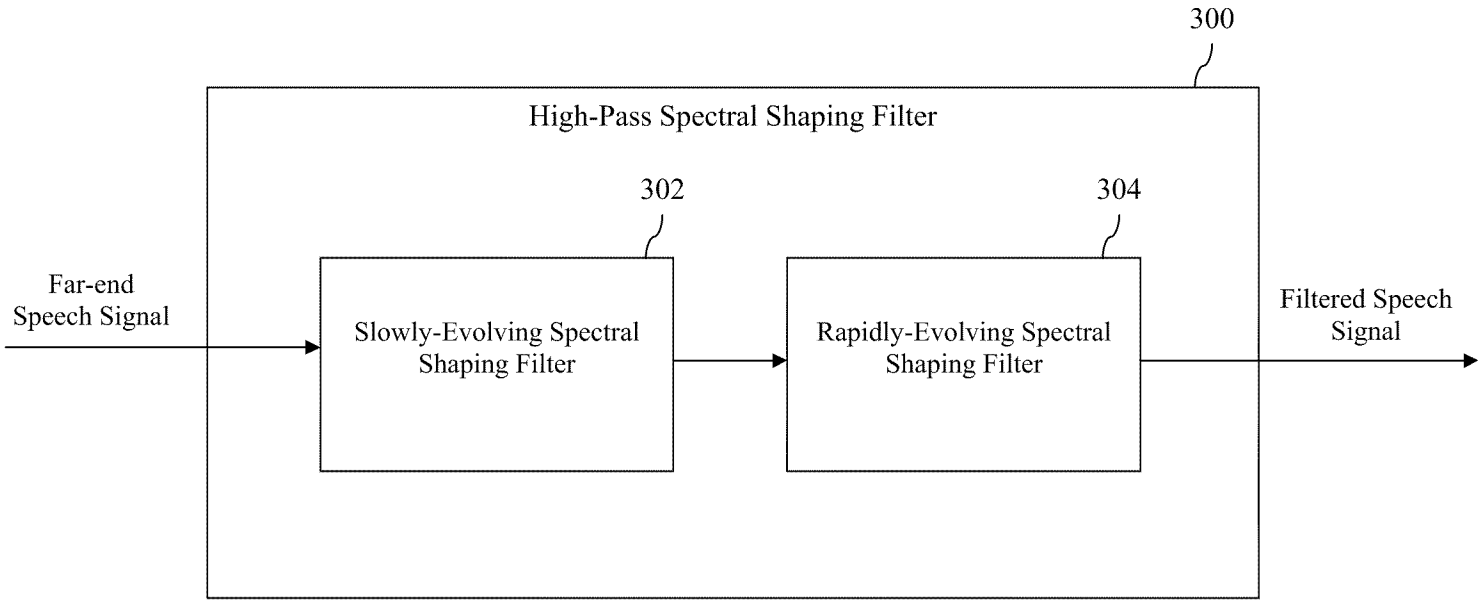
FIG. 3 depicts a block diagram of a high-pass spectral shaping filter that may be used to implement an SIE system in accordance with an embodiment of the present invention.

In one embodiment of the present invention, the high-pass spectral shaping filter consists of two cascaded filters: a slowly-evolving spectral shaping filter and a rapidly-evolving spectral shaping filter, each of which is controlled by different adaptation mechanisms. FIG. 3 depicts a block diagram of such a high-pass spectral shaping filter 300. As shown in FIG. 3, the high-pass spectral shaping filter 300 consists of a slowly-evolving spectral shaping filter 302 and a rapidly-evolving spectral shaping filter 304.

In accordance with one implementation, slowly-evolving spectral shaping filter 302 has the form of $$x(n)=r_{in}(n)-b\cdot r_{in}(n-1), \tag{1}$$

where x(n) is the output, $r_{in}(n)$ is the input, and b is the filter coefficient. The filter coefficient is determined according to a table lookup $$b=b_{tbl}[idx], \tag{2}$$

where the table can be $$b_{tbl}[\,]=\{0.0,0.1,0.2,0.3,0.4,0.5,0.6,0.7,0.8\}, \tag{3}$$

and the index is determined according to $$idx=(N_{b_{tbl}}-1)\cdot\left\lfloor\frac{\min(V_{loss}(k-1),\ mxV_{loss})}{mxV_{loss}}\right\rfloor \tag{4}$$

in which $N_{b_{tbl}}$ is the table size, e.g., $N_{b_{tbl}}=9$ above, $V_{loss}(k-1)$ the smoothed volume loss (or loss in headroom) due to compression applied by compression logic 226 as tracked by compression tracker 210, and $mxV_{loss}$ is a smoothed volume loss at which maximum slowly varying spectral shaping is applied, e.g., $mxV_{loss}=27$.

Figure 4:
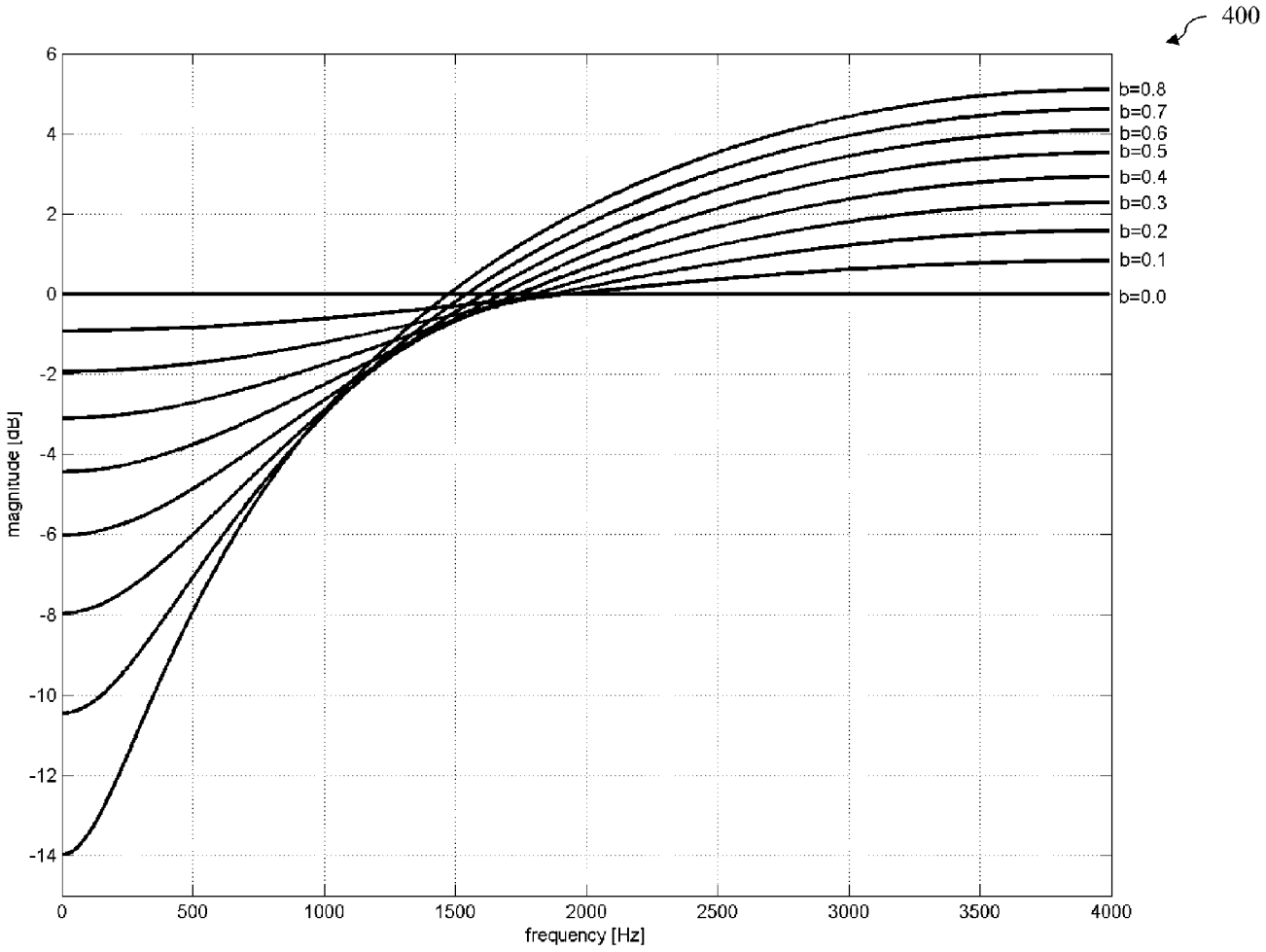
FIG. 4 is a graph showing a family of frequency response curves for a slowly-evolving spectral shaping filter in accordance with an embodiment of the present invention.

The frequency response of the filters given by the coefficients in Eq. 3 and the filter of Eq. 1 are shown in graph 400 of FIG. 4. As can be seen, the filters will generally attenuate the first formant while amplifying formants 2 and above, thereby increasing intelligibility. In a possible configuration for wideband speech where this filter is applied to the 0-4 kHz band, a constant gain can be applied to the 4-8 kHz band to prevent a spectral discontinuity at 4 kHz, and instead facilitate a continuous full-band modification of the signal. The gain for the 4-8 kHz band would depend on the filter coefficient. The gains corresponding to the filter coefficients of Eq. 3 are {1.0, 1.1, 1.2, 1.3, 1.4, 1.5, 1.6, 1.7, 1.8}.

In one implementation, rapidly-evolving spectral shaping filter 304 includes two control parameters. The first control parameter is given by $$\text{ratio}=1-10^{-(\alpha\cdot V_{loss}(k-1)/20)}, \tag{5}$$

where $\alpha$ is a control parameter, e.g. $\alpha$=0.375. The second control parameter is given by $$rho = \frac{r_{sm}(k, 1)}{r_{sm}(k, 0)}, \tag{6}$$

where $$r_{sm}(k,m)=\lambda \cdot r_{sm}(k-1,m)+(1-\lambda)\cdot r_{cor}(m) \tag{7}$$

The smoothing constant $\lambda$ can have a value of 0.75, for example. In the equation the auto correlation is calculated as $$r_{cor}(m) = \sum_{n=0}^{N-m} r_{in}(n) \cdot r_{in}(n-m) \tag{8}$$

where N is the frame size, e.g. 40 samples, corresponding to 5 ms at 8 kHz. The final filter coefficient of rapidly evolving spectral shaping filter 304 is given by $$c=\max(\gamma \cdot \text{rho} \cdot \text{ratio},0), \tag{9}$$

where $\gamma$ controls the maximum filter coefficient, e.g. $\gamma$=0.75. The filter equation for the rapidly evolving spectral shaping is given by $$y(n)=x(n)-c\cdot x(n-2)-c\cdot y(n-1). \tag{10}$$

In accordance with the foregoing, rapidly-evolving spectral shaping filter 304 is a second-order pole-zero high-pass filter having one pole and two zeros, with a transfer function of $$H_{re}(z) = \frac{1 - cz^{-2}}{1 + cz^{-1}} \tag{11}$$

where c is the single parameter that controls the shape of the frequency response of the filter. The family of frequency response curves for different values of c is plotted in graph 500 of FIG. 5. This filter is designed to be totally controlled by a single parameter c. This makes it simple to implement and to adapt from frame to frame.

Rapidly-evolving spectral shaping filter 304 is designed to have relatively sharp attenuation at or below about 500 Hz, where the first formant of voiced speech usually is. Also, it boosts the second and third formants relative to the first formant. This filter is also designed to have exactly the same magnitude response value of 0 dB at half the sampling frequency. This makes it easier to achieve a seamless transition to a higher band when using a split-band system in wideband applications. In other words, a high band filter can always start at 0 dB no matter what the value of the filter control parameter c is, and the corresponding composite magnitude response will always be continuous at the band boundary of the low band (where this filter is) and the high band.

Figure 5:
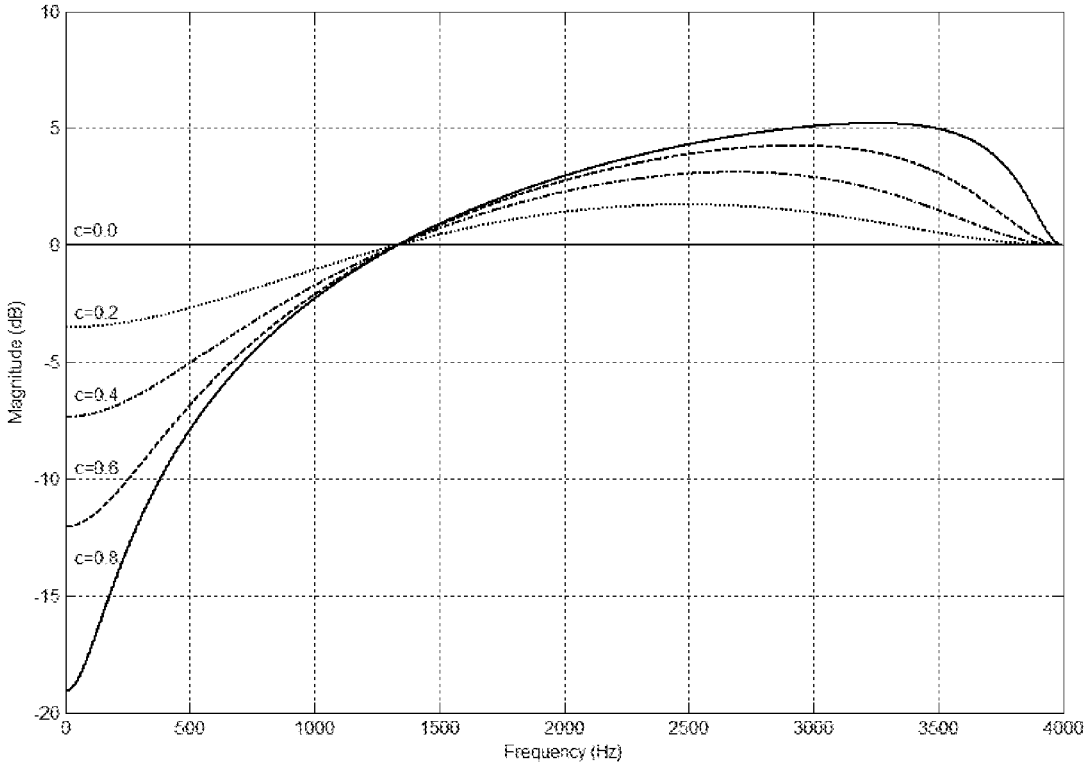
FIG. 5 is a graph showing a family of frequency response curves for a rapidly-evolving spectral shaping filter in accordance with an embodiment of the present invention.

Another important feature is that at frequencies above 3400 Hz, the magnitude responses in FIG. 5 always go down toward 0 dB. This arrangement has the desirable effect of not excessively amplifying the potential noise in the far-end speech signal in the stop band of 3400 to 4000 Hz.

Slowly-evolving spectral shaping filter 302 and rapidly-evolving spectral shaping filter 304 can be combined into a single spectral shaping filter, if desired, by convolving the filter response of slowly evolving spectral shaping filter 302 with the zero section of rapidly evolving spectral shaping filter 304, and maintaining the pole section of rapidly evolving spectral shaping filter 304.

Note that in the specific implementation discussed above, the operation of slowly-evolving spectral shaping filter 302 and rapidly-evolving spectral shaping filter 304 is controlled, in part, by $V_{loss}(k-1)$, which is the smoothed volume loss (or loss in headroom) resulting from compression applied by compression logic 226 and fed back by compression tracker 210. The smoothed volume loss provides an indication of the remaining shortage of intelligibility in the far-end speech signal after the application of compression thereto. This shortage must be compensated for using different means in order to reach a minimum SNR for intelligibility. Hence, in accordance with this embodiment, the amount of spectral shaping applied is a function of the smoothed volume loss.

However, the present invention is not limited to this approach and spectral shaping may be applied to the far-end speech signal in a manner that is not controlled by the smoothed volume loss or by any other measurement of the degree of compression applied to the far-end speech signal by compression logic 226. Furthermore, although spectral shaping is described herein as one of a plurality of techniques used for performing SIE, persons skilled in the relevant art(s) will appreciate that spectral shaping alone can be used to enhance speech intelligibility.

2. Dispersion Filter 204

As shown in FIG. 2, dispersion filter 204 may be inserted after spectral shaping block 202 but before an input level estimator 206. Depending upon the implementation, dispersion filter 204 could also be merged with the spectral shaping filter(s) in spectral shaping block 202 to form a single filter, or it could be moved ahead of spectral shaping block 202.

The function of dispersion filter 204 is to reduce the peak-to-average ratio for waveform sample magnitudes of the far-end speech signal. One way to measure the "average" is the Root-Mean-Square (RMS) value that is well-known in the art. Some of the speech vowel signals are fairly "peaky"—that is, they have a high peak-to-RMS ratio. In this case, such speech signals cannot be amplified to a very loud level before the waveform peaks are clipped at digital saturation level. Dispersion filter 204 can "disperse" or effectively smear out such waveform peaks so that the energy of the waveform peak is more evenly distributed across the time axis after such filtering. When it achieves this, the peak-to-RMS ratio is reduced. In other words, for the same RMS value or energy level, the waveform magnitude peak is reduced, leaving more "headroom" to digital saturation for AVB logic 224 to utilize. The waveform can then be amplified more before clipping occurs, and this will boost the effective volume of the far-end speech signal and enhance the speech intelligibility. Generally speaking, if dispersion filter 204 can reduce the peak-to-RMS ratio by X dB and if AVB logic 224 can fully utilize this additional X dB of headroom, then after application of AVB the output signal level will be X dB higher without clipping.

There are many ways to perform dispersion filtering. Since one of the objectives of the SIE system and method is to minimize the distortion introduced to the far-end speech signal, an exemplary embodiment of the present invention uses an all-pass filter as the dispersion filter, because an all-pass filter has a completely flat magnitude frequency response of value 1 and thus does not introduce any magnitude distortion whatsoever. The only distortion it can introduce is phase distortion, but human ears are generally not very sensitive to phase distortion.

Since the magnitude frequency response of an all-pass filter has value 1 for all frequencies, the input signal and the output signal of an all-pass filter have exactly the same RMS value. Therefore, with all-pass filtering, minimizing the peak-to-RMS ratio is exactly the same as minimizing the waveform peak value.

As is well-known in the art, an all-pass filter is a pole-zero filter with the numerator polynomial and denominator polynomial of its transfer function sharing the same set of polynomial coefficients except with the order reversed. With proper design, even a fixed $6^{th}$-order all-pass filter can provide on average nearly 2 dB of reduction in the peak-to-RMS ratio of high-magnitude speech vowel signals. An example transfer function of such a fixed $6^{th}$-order all-pass filter optimized for 8 kHz sampled speech is given below.

$$H(z) = \frac{a_6 + a_5 z^{-1} + a_4 z^{-2} + a_3 z^{-3} + a_2 z^{-4} + a_1 z^{-5} + z^{-6}}{1 + a_1 z^{-1} + a_2 z^{-2} + a_3 z^{-3} + a_4 z^{-4} + a_5 z^{-5} + a_6 z^{-6}} \quad (12)$$

The filter coefficients may be, for example, $a_1=-1.787$, $a_2=2.432$, $a_3=-2.565$, $a_4=2.171$, $a_5=-1.408$, $a_6=0.699$. An exemplary embodiment of the present invention can use such a fixed all-pass filter. Using such a fixed all-pass filter has the advantage of relatively low complexity.

It is also possible to make the all-pass filter adaptive to achieve more waveform peak reduction, albeit at the cost of higher complexity. The poles and zeros of the all-pass filter can be adapted according to the local characteristics of the speech waveform so as to maximize the reduction of the waveform peak magnitude. In addition, just as the smoothed volume loss, $V_{loss}(k)$, can be used to control the spectral shaping filter(s) in spectral shaping block 202, $V_{loss}(k)$ can also be used to control an adaptive all-pass filter. For example, similarly to how the spectral shaping is gradually increased by an increasing $V_{loss}(k)$, the amount of dispersion can be gradually increased by an increasing $V_{loss}(k)$. This can be achieved by mapping the $V_{loss}(k)$ to a scaling factor that is applied to the radii of the poles of the dispersion filter. The mapping maps a low $V_{loss}(k)$ to a scaling factor close to zero (effectively disabling dispersion), and a high $V_{loss}(k)$ to a scaling factor close to one (allowing full dispersion). The usage of $V_{loss}(k)$ to control the dispersion is shown by the dashed line connecting compression tracker 210 to dispersion filter 204 in FIG. 2.

Figure 6:
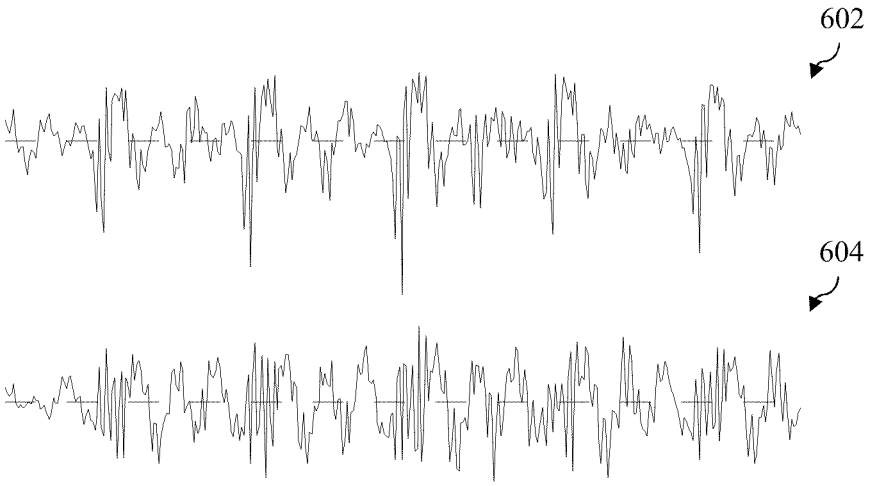
FIG. 6 depicts a first plot that shows an example male speech waveform before dispersion filtering and a second plot that shows the same segment of speech waveform after dispersion filtering.

The effect of all-pass dispersion filtering is illustrated in FIG. 6, where an example male speech waveform before the dispersion filtering is shown in an upper plot 602, and the same segment of speech waveform after dispersion filtering is shown in a lower plot 604. The two horizontal dashed lines represent the lines corresponding to zero signal magnitude for these two waveforms, respectively. Note that the two waveforms have identical energy values and even sound essentially the same, because the dispersion filter used was an all-pass filter.

It can be seen from FIG. 6 that the waveform in upper plot 602 has about five periods of nearly periodic pitch cycle waveform, where each period has a sharp negative peak. After all-pass dispersion filtering, these sharp negative peaks were spread out into many smaller peaks, and the maximum signal magnitude is reduced in the process. Specifically, the speech waveform in upper plot 602 has the largest negative peak in the middle of the plot with a magnitude of 8822 in a 16-bit linear PCM representation. After all-pass dispersion filtering, the filter output signal in lower plot 604 has a maximum magnitude of 4544. This represents a peak magnitude reduction of 5.76 dB. In the ideal situation in which AVB logic 224 can fully utilize this reduced peak magnitude (i.e. increased "digital headroom"), AVB logic 224 can boost the intensity of the signal in the lower plot 5.76 dB more than it can boost the intensity of the signal in the upper plot before reaching the digital saturation level. Therefore, in this example of FIG. 6, compared with the unfiltered signal shown in plot 602, the signal after dispersion filtering shown in plot 604 can be boosted to be 5.76 dB higher in intensity in an ideal situation.

Figure 7:
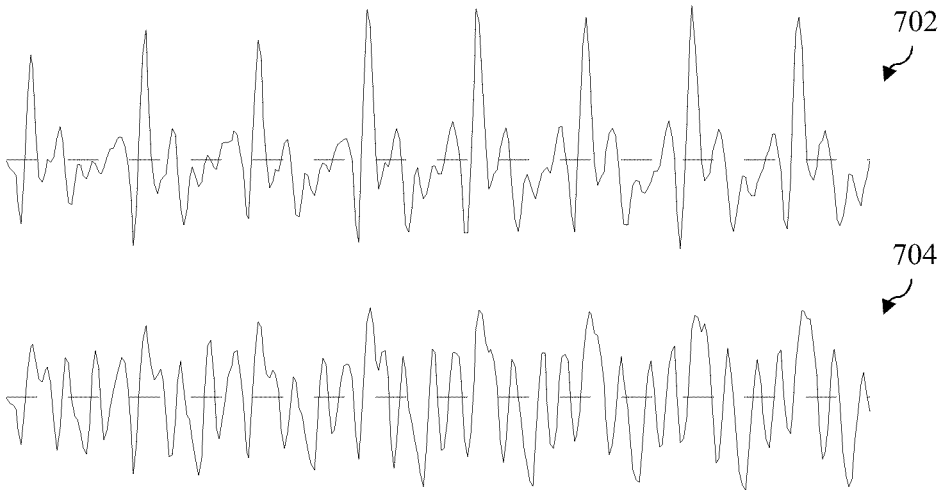
FIG. 7 depicts a first plot that shows an example female speech waveform before dispersion filtering and a second plot that shows the same segment of speech waveform after dispersion filtering.

A similar waveform plot for an example female speech signal is shown in FIG. 7. In particular, an example female speech waveform before dispersion filtering is shown in an upper plot 702, and the same segment of speech waveform after dispersion filtering is shown in a lower plot 704. In this case, the sharp positive waveform peaks in upper plot 702 were reduced in lower plot 704, and the all-pass filter reduced the peak magnitude by 4.44 dB. In both FIG. 6 and FIG. 7, a $6^{th}$-order all-pass filter optimized for that segment of speech signal was used.

Through experiments, it was found that the optimal all-pass filter for a given frame of voiced speech signal usually has its poles and zeros located near but not exactly at the speech formant frequencies. (Here "optimal" is in the sense of minimizing the peak-to-RMS ratio, or equivalently, minimizing the waveform peak magnitude.) Also, it was found that the degree of waveform peak reduction is controlled by how close the poles (and the corresponding zeros) of the all-pass filter are to the unit cycle. As the radii of the poles approach the range of 0.90 to 0.95, large waveform peak reduction can be achieved. On the other hand, as the radii of the poles approaches zero, the effect of all-pass filtering gradually diminishes.

Based on such an observation, an exemplary embodiment of the present invention employs an adaptive all-pass filter where the radii of its poles are set at or near zero during silence regions of the far-end speech signal and are adapted toward the range of 0.90 to 0.95 during high-magnitude vowel regions. Also, at or near the beginning of a voiced region of the far-end speech signal, the frequencies (or equivalently, polar angles) of the poles of the adaptive all-pass filter are set to the pole frequencies of an optimal fixed all-pass filter, such as the $6^{th}$-order fixed all-pass filter shown above. Then, during the syllable of that vowel sound, the pole frequencies are adapted frame by frame to try to maintain near optimality by tracking the change in that vowel speech signal. One example way of performing such tracking is to estimate the formant frequencies and then use such formant frequencies to guide the adaptation of the pole frequencies of the all-pass filter (with the corresponding changes to the frequencies of the zeros).

The estimate of formant frequencies need not be very accurate, and certainly not to the same degree of accuracy required by some formant-based speech synthesis systems. Basically, in terms of minimizing the waveform magnitude peak, what matters is the relative phase relationship between pitch harmonics near prominent peaks of the spectral envelope of the speech signal. Therefore, even a crude estimation of rough formant frequencies based on picking frequencies of spectral peaks in the frequency response of a short-term predictive synthesis filter (often called the "LPC filter" in speech coding literature) will suffice.

In addition to (or in place of) such guidance from estimated formant frequencies, one can also use a closed-loop pole frequency search to find the optimal pole frequencies and to guide the adaptation of such pole frequencies. It was found that when an all-pass filter is used, the pole frequencies cannot change too much from frame to frame, otherwise there will be a significant difference in the group delays of the filtered signals in the adjacent frames which will cause an audible waveform disturbance. To minimize the possibility of such distortion, the closed-loop pole frequency search limits this search range to be in the neighborhoods of the previous pole frequencies. It was found that a frequency resolution of 5 to 10 Hz is sufficient to achieve most of the magnitude peak reduction. Therefore, a few pole frequency candidates, which are in the neighborhood of the pole frequencies used in the last frame and which are 5 to 10 Hz away from each other, are tried, and the set of pole frequencies achieving the maximum waveform peak reduction subject to a constraint of tracking the formant trajectory is selected as the winner for the current frame, and the all-pass filter is constructed from this set of pole frequencies and a given set of default pole radii.

In the example all-pass filters described above, a filter order of 6 was used because that gives three pole pairs (and the corresponding three zero pairs), which are sufficient to track the first three formants in speech signals that account for most of the speech energy. During the search of the optimal pole frequencies for the adaptive all-pass filter, it is advantageous in terms of computational complexity to search one pole pair at a time. For example, the frequency of the first pole pair can be searched in the frequency range of the first speech formant (typically 270 to 730 Hz) using a frequency grid of 5 to 10 Hz. After the frequency of the first pole pair that minimizes the waveform peak magnitude is identified, with the first pole pair fixed at that optimal frequency and with the effect of the first pole pair taken into account, the frequency of the second pole pair can then be searched in the frequency range of the second speech formant (typically 840 to 2290 Hz). Similarly, after the optimal frequency of the second pole pair is also identified and the effect of the optimal second pole pair taken into account, the frequency of the third pole pair can be searched in the frequency range of the third speech formant (typically 1690 to 3010 Hz). It is also possible to do joint optimization of the frequencies of the pole pairs. Although it has a higher complexity, an adaptive all-pass filter has the potential of achieving significantly more waveform peak reduction than a fixed all-pass filter.

Besides a fixed all-pass filter and a fully adaptive all-pass filter, a third possible implementation for dispersion filter 204 is a switched-adaptive all-pass filter, which achieves a compromise between a fixed all-pass filter and a fully adaptive all-pass filter in terms of complexity and performance. In a switched-adaptive all-pass filter, a collection of N all-pass filter candidates are carefully pre-designed and optimized. Then, in actual filtering, each of the N filter candidates is tried, and the system identifies the filter candidate that minimizes the speech waveform peak magnitude while also satisfying the constraint that the differences between the pole locations (or group delays) of filters in adjacent frames are below pre-set thresholds. Simulations have shown that such a switched-adaptive all-pass filter can achieve significant improvement in waveform peak magnitude reduction over a fixed all-pass filter while also avoiding the waveform distortion due to significant difference between group delays of the filter output signals of adjacent frames.

3. Level Estimator 206

In SIE system 200, level estimator 206 is configured to perform level estimation on the signal output from dispersion filter 204 (i.e., the far-end speech signal after spectral shaping and dispersion filtering have been applied thereto). However, depending upon the implementation, the level of the original far-end speech signal input to spectral shaping block 202 can instead be estimated, or level estimation can be performed on both the signal input to spectral shaping block 202 and the signal output from dispersion filter 204. However, for complexity considerations it may be desirable to perform level estimation on only one of the signals, and in practice SIE system 200 will perform satisfactorily when level estimation is performed only on the output of dispersion filter 204. As shown in FIG. 2, in one embodiment, another component within the telephony device in which SIE system 200 is implemented provides a measure of voice activity in the receive-in signal as input to level estimator 206. For example, the other component may be a sub-band acoustic echo canceler (SBAEC). The measure of voice activity can be implemented in many ways. One example is to count the number of sub-bands where the energy significantly exceeds the noise floor.

4. Waveform Envelope Tracker 208

Waveform envelope tracker 208 is configured to perform waveform envelope tracking on the signal output from dispersion filter 204 (i.e., the far-end speech signal after spectral shaping and dispersion filtering have been applied thereto) and to provide waveform tracking information to AGC/AVB/compressor block 212. This allows AGC/AVB/compressor block 212 to determine exactly how much headroom there is to digital saturation in the signal prior to modifying it. In one embodiment, waveform envelope tracker 208 is configured to calculate the maximum absolute amplitude of the signal waveform in the current frame, e.g. 5 milliseconds (ms). In further accordance with this embodiment, waveform envelope tracker 208 also maintains a buffer of the maximum absolute amplitudes of the past two 5 ms frames. This allows waveform envelope tracker 208 to calculate the maximum absolute amplitude of the signal waveform over the past 15 ms. The intent in covering 15 ms is to make sure that at least one pitch period is considered in the maximum. For some talkers of particular low pitch frequency it may be advantageous to increase this value from 15 ms to a larger value. In accordance with this embodiment, waveform envelope tracker 208 calculates the waveform tracking information as $$mx(k)=\max[\phi 15/16\cdot mx(k-1))], \tag{13}$$

where k is the frame counter and $\phi$ is the maximum absolute amplitude of the signal waveform over the past 15 ms. Effectively, this embodiment of waveform envelope tracker 208 provides instant attack and exponential decay.

5. AGC/AVB/Compressor Block 212

Figure 8:
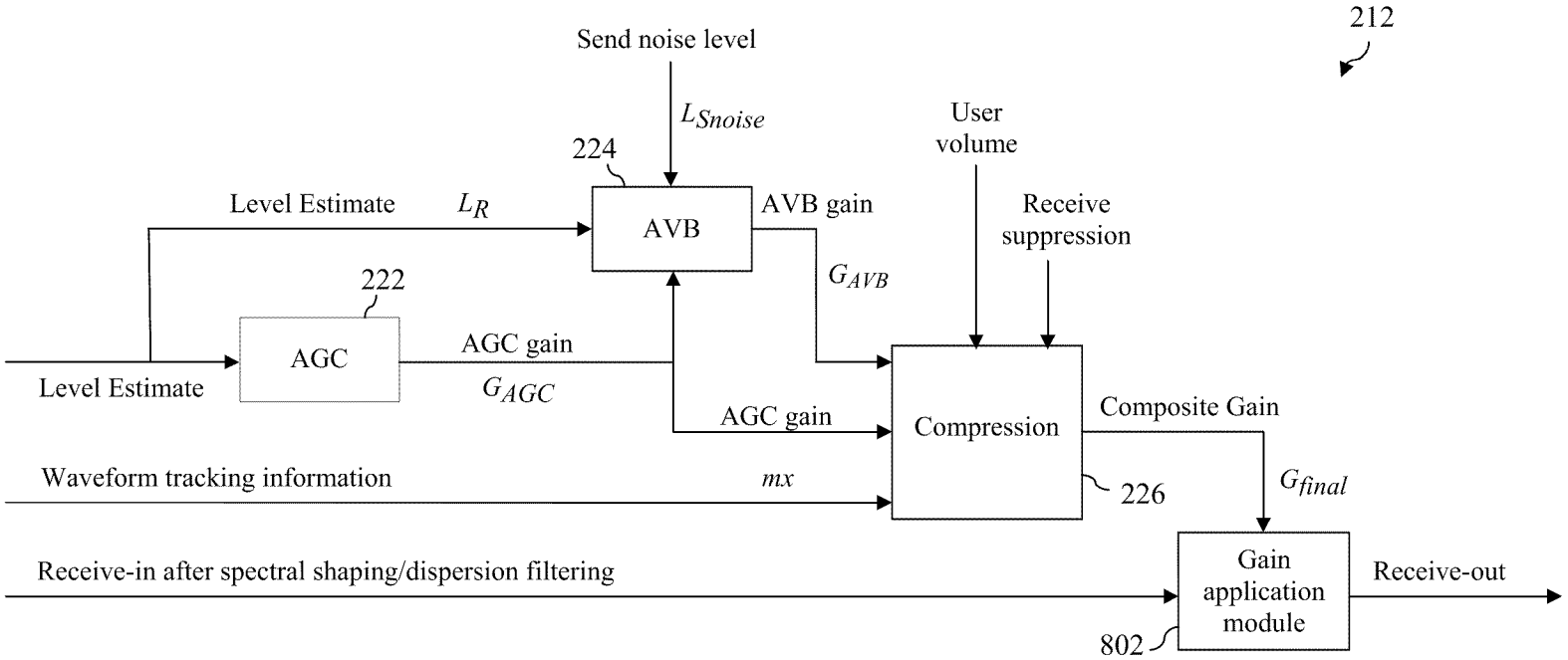
FIG. 8 is a block diagram of an automatic gain control (AGC)/automatic volume boost (AVB)/compression block in accordance with an embodiment of the present invention.

FIG. 8 is a block diagram that depicts AGC/AVB/compression block 212 of FIG. 2 in more detail in accordance with an embodiment of the present invention. The manner in which this particular embodiment of AGC/AVB/compression block 212 operates will now be described. It is noted that all gain and volume arithmetic described in this section is carried out in the log domain.

First, AGC logic 222, if enabled, calculates a logarithmic AGC gain to bring the input signal (i.e., the signal output from dispersion filter 204) to a predefined nominal level:

$$G_{AGC}=L_{nom}-L_R, \tag{14}$$

where $L_{nom}$ is the predefined nominal level and $L_R$ is the estimated input level as provided by level estimator 206. In one embodiment, $G_{AGC}$ is subject to a minimum and maximum, e.g. −20 dB and +20 dB. An alternate implementation of this AGC logic is described below in Section D.

Subsequently, AVB logic 224 calculates the receive-to-ambient-background-noise ratio after AGC as $$R2Snoise=\text{default_volume}+G_{AGC}+L_R+C-L_{Snoise}, \tag{15}$$

where default_volume is a constant representing a volume providing a comfortable listening level in quiet conditions, $L_{Snoise}$ is the estimated ambient noise level, and C is a calibration term to ensure that R2Snoise reflects what the user is experiencing. In one embodiment, the parameter $L_{Snoise}$ may be provided from another component within the telephony device in which SIE system 200 is implemented. For example, the other component may be a sub-band acoustic echo canceler (SBAEC).

AVB logic 224 then calculates the target AVB gain as $$TG_{AVB} = \begin{cases} 0 & R2Snoise > TR2Snoise \\ \min[TR2Snoise - R2Snoise, mxG_{AVB}] & \text{otherwise,} \end{cases} \quad (16)$$

where TR2Snoise is the minimum target SNR between speech and ambient background noise, and $mxG_{AVB}$ is a maximum allowable AVB gain, e.g. 20 dB. In order to change the AVB gain gradually, in one embodiment it is constrained to change in small step sizes, and the actual AVB gain is calculated as $$G_{AVB}(k) = \begin{cases} G_{AVB}(k-1) + \Delta & TG_{AVB} > G_{AVB}(k-1) + \Delta \\ G_{AVB}(k-1) - \Delta & TG_{AVB} < G_{AVB}(k-1) - \Delta \\ G_{AVB}(k-1) & \text{otherwise} \end{cases}, \quad (17)$$

where Δ is the step size, e.g. 1 dB.

With respect to the minimum target SNR, in practice a value of 15 dB may work in an embodiment in which the telephony terminal is a hanging style Bluetooth® headset. However, it is anticipated that the specific value will depend somewhat on the actual telephony terminal implementation. For example, an alternative Bluetooth® headset having an in-ear style speaker that provides a good acoustic seal will prevent some of the ambient background noise from reaching the auditory system of the user. In that case, a lower minimum SNR such as 6 dB may work. If the attenuation by the seal is accounted for in the calculations in the algorithm, e.g. the SNR is specified at the point of the ear drum, then the desired minimum SNR should be more device independent. However, in practice it may not be simple to account for such factors as the seal.

The receive-signal-to-ambient-background-noise ratio is a key parameter that is monitored by SIE system 200. Note that the far-end speech signal and the near-end noise are two different signals in two different domains. Even for the same far-end speech signal level as "seen" by SIE system 200, different loudness levels may be perceived by the user of the near-end telephony terminal depending on the gain applied to the speech signal before playback, the loudspeaker sensitivity, and a number of other factors. Similarly, even for the same near-end background noise level in the acoustic domain, SIE system 200 may see different noise levels depending on the microphone sensitivity, the gain applied to the microphone signal, or the like. Therefore, it is anticipated that for each type of telephony terminal, some calibration will be needed so that the predetermined SNR target as measured by the SIE system and method makes sense.

After the actual AVB gain has been calculated, AVB logic 224 then calculates the desired total gain as $$G_{desired} = \text{volume} + G_{AGC} + G_{AVB}, \quad (18)$$

where volume is the user volume of the telephony terminal (set by the user). Depending upon the implementation, there could be an additional term corresponding to a loss dictated by an echo suppression algorithm. This term is shown as "receive suppression" in FIGS. 2 and 8 and may be received, for example, from a sub-band acoustic echo cancellation (SBAEC) component or other component within the telephony device.

Compression logic 226 then computes the final gain, wherein the final gain represents any compression that will be applied. The instant attack of the waveform envelope tracking as described above in reference to Eq. 13 taken together with the following gain calculations essentially guarantees that saturation and clipping will never occur.

To compute the final gain, compression logic 226 first calculates a compression point, $C_p$, relative to maximum digital amplitude in a manner that is adaptive and that takes into account the user volume and a calibration value for a "nominal" user (at a nominal listening level in quiet):

$$C_p = \max\lfloor C_{p,default_volume} + (\text{default_volume} - \text{volume}), 0 \rfloor, \quad (19)$$

where $C_{p,default_volume}$ is the compression point at a user volume of default_volume. One can think of $C_{p,default_volume}$ as the maximum comfortable waveform level for a user that would use default_volume in quiet.

This adaptive approach to determining the compression point advantageously allows the compression point to move up and down with the user volume. For example, a compression point of 6 dB means that compression logic 226 will limit the waveform amplitude to 6 dB below maximum digital amplitude. For a user who prefers and uses a higher volume compared to another user, this means that compression point will be closer to maximum digital amplitude, and hence the signal will compressed at a higher level allowing higher waveform levels. For a user with a 3 dB louder volume setting, the compression will occur at a waveform amplitude that is 3 dB higher.

In further accordance with this approach, the waveform amplitude will be limited by compression logic 226 to a level that is below the maximum digital amplitude, and hence the full digital range may not be utilized for some users. In cases where this is undesirable, the compression point could be fixed to 0 dB. For example, this could apply to telephony terminals that are unable to provide sufficient volume for any user. However, where a telephony terminal is capable of providing more than enough loudness for a user (i.e., the loudness can be increased to a point that is uncomfortable for the user), the above approach of adaptively determining the compression point ensures that a level of discomfort will not be exceeded. Instead, loudness is achieved by amplifying the lower level segments while preventing the higher level segments from exceeding the compression point, which can be viewed as representing the maximum waveform amplitude of comfort.

Consequently, using this adaptive approach to determine the compression point, a higher maximum waveform is allowed for a user with a higher user volume setting, acknowledging that this particular user prefers louder levels. Conversely, a user with high sensitivity applying a lower user volume setting will be protected by a lower compression point (further below maximum digital amplitude). Instead of achieving intelligibility by uncomfortable levels via linear gain, the intelligibility is achieved by the additional features such as amplification of lower levels, spectral shaping, and dispersion.

In some sense, the adaptive nature of the compression point offers acoustic shock protection to users by limiting the maximum amplitude of waveforms that the auditory system is exposed to. The use of such a compression point also means that sometimes the maximum possible linear gain is not applied, and instead intelligibility is achieved by other means in order to honor the user's sensitivity to pure linear gain. Hence, in the interest of avoiding user discomfort, processing that introduces distortion in a traditional sense may be activated before distortion-less processing (linear gain) has been exhausted. However, from the perspective of the auditory system of the user the discomfort can be considered a distortion, and hence the above-described application of processing that increases distortion in a traditional sense should not be considered a violation of the prescribed philosophy of applying increasingly more aggressive processing as noise levels increase.

Furthermore, not only does the adaptive compression point accommodate users with different sensitivity, it also accommodates a varying acoustic seal for a single user. This frequently occurs when the user is using a cellular telephone, Bluetooth® headset, or like device that is often coupled and uncoupled from the ear, acoustically. If the seal is 3 dB worse during one use, the user would naturally increase volume by 3 dB to achieve the same loudness. Consequently, the compression point will move up by 3 dB, and everything will behave as before. As can be seen from Eq. 19 the compression point is not allowed to go beyond 0 dB, i.e. the maximum digital amplitude. This, along with the instant attack of the waveform tracking, prevents any kind of saturation.

It should be noted that in some cases it may be beneficial to allow some digital saturation since this will also provide some additional loudness. In terms of determining the permissible amount of saturation, a suitable trade-off must be made between loudness and distortion from saturation. As described in commonly-owned, co-pending U.S. patent application Ser. No. 12/109,017 (entitled "Audio Signal Shaping for Playback by Audio Devices" and filed Apr. 24, 2008), the entirety of which is incorporated by reference herein, soft-clipping may be used to minimize objectionable distortion. In such an implementation, the threshold in Eq. 19 will not be 0, but rather a negative number with an absolute value corresponding to the acceptable level of clipping.

After the compression point $C_p$ has been determined, compression logic 226 calculates the overall gain headroom, $G_{headroom}$, between the waveform and the compression point as $$G_{headroom} = 20 \cdot \log_{10}\left(\frac{MAXAMPL}{mx(k)}\right) - G_{margin} - C_p \tag{20}$$

where MAXAMPL is the maximum digital amplitude of the output in the system, e.g. 32768 for a 16-bit output. The gain headroom is calculated as the gain required to bring the waveform envelope tracking information, denoted mx(k), to the compression point, or just below if a margin, $G_{margin}$, is desired due to finite precision of fixed point arithmetic, e.g. $G_{margin}$=1 dB. In the special case where the compression point is 0 dB, and hence corresponds to the point of saturation, the gain headroom corresponds to the headroom between the waveform envelope and saturation, less the margin, $G_{margin}$.

Compression logic 226 then calculates the final gain, $G_{final}$, to be applied to the current frame as the minimum of the desired linear gain and the gain headroom (observing the compression point). The time-varying final gain creates the compression effect due to lower level frames having greater gain headroom than higher level frames.

$$G_{final}=\min[G_{desired}, G_{headroom}], \tag{21}$$

Compression logic 226 then converts the final gain $G_{final}$ from the log domain to the linear domain $$g=10^{G_{final}/20} \tag{22}$$

and gain application module 802 applies the converted gain g to the output signal from spectral shaping block 202/dispersion filter 204 to produce the output signal (denoted "receive-out" in FIGS. 1 and 2) for playback via a loudspeaker of the telephony terminal:

$$r_{out}(n)=g \cdot y(n). \tag{23}$$

6. Compression Tracker 210

Compression tracker 210 is configured to monitor the shortage in headroom, or instantaneous volume loss $$V_{instloss}=G_{desired}-G_{final}, \tag{24}$$

and to calculate an average version according to the following equations. First a peak tracker is updated according to $$V_{peakloss}(k) = \begin{cases} V_{linstoss} & V_{linstoss} > V_{peakloss}(k) \\ \frac{4095}{4096} \cdot V_{peakloss}(k-1) & \text{otherwise.} \end{cases} \tag{25}$$

Then, compression tracker 210 applies second order smoothing to calculate the smoothed volume loss $$V_{loss}(k)=2\beta \cdot V_{loss}(k-1)-\beta^2 \cdot V_{loss}(k-2)+1/\beta \cdot V_{peakloss}(k), \tag{26}$$

where β is a smoothing factor, e.g. β=1023/1024. Compression tracker 210 feeds back the smoothed volume loss $V_{loss}(k)$ back to spectral shaping block 202 and optionally dispersion filter 204 to control the operation thereof.

C. Alternate System Implementation

Figure 9:
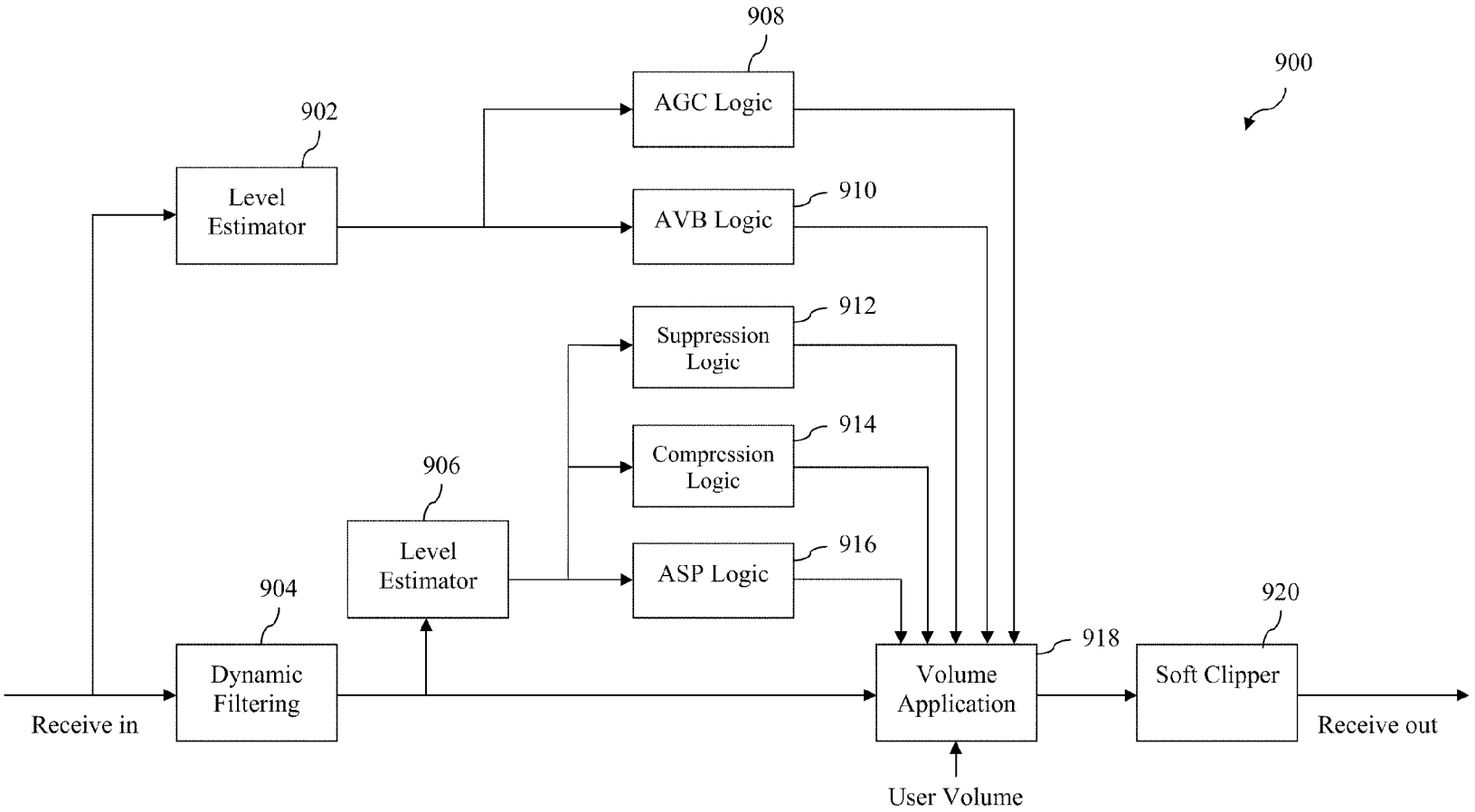
FIG. 9 is a block diagram of an example SIE system in accordance with an alternate embodiment of the present invention.

FIG. 9 is a block diagram of an example SIE system 900 in accordance with an alternate embodiment of the present invention. Like SIE system 200 described above in reference to FIG. 2, SIE system 900 is configured to improve the intelligibility of a speech signal received over a communication network from a far-end telephony terminal (the "far-end speech signal") for playback by a near-end telephony terminal of which SIE system 900 is a part. In FIG. 9, the far-end speech signal is denoted "Receive in." The output of SIE system 900 is the modified far-end speech signal, denoted "Receive out."

As shown in FIG. 9, SIE system 900 includes a first level estimator 902, a dynamic filtering block 904, a second level estimator 906, AGC logic 908, AVB logic 910, suppression logic 912, compression logic 914, acoustic shock protection (ASP) logic 916, a volume application block 918 and a soft clipper 920. Each of these elements will now be described.

First level estimator 902 is configured to determine an estimated level of the far-end speech signal and to provide this information to AGC logic 908 and AVB logic 910 for use in performing gain calculations. By performing level estimation directly on the original far-end speech signal (as opposed to the far-end speech signal after processing by dynamic filtering block 904), first level estimator 902 is able to provide AGC logic 908 and AVB logic 910 with a more accurate estimate of the level of the far-end speech signal as received from the communication network. However, in accordance with this implementation, first level estimator 902 cannot take into account any loss in level due to the processing of the far-end speech signal by dynamic filtering block 904. In contrast, if level estimation for the purposes of performing AGC and AVB operations were performed after dynamic filtering, this could lead to the removal of the higher intensity components (i.e., lower-frequency components) which have less impact on intelligibility or loudness. In either case, one could include logic to compensate for the loss of loudness due to the operations of dynamic filtering block 904 to provide a more accurate estimate of the final loudness that a user would experience.

Dynamic filtering block 904 is configured to filter the far-end speech signal in an adaptive manner in order to increase intelligibility of the signal and to obtain more digital headroom for boosting of the signal by AVB logic 910 while avoiding the introduction of an impermissible level of digital saturation. The operations performed by dynamic filtering block 904 may include any of the functions attributed to spectral shaping block 202 and/or dispersion filter 204 as described above in reference to system 200 of FIG. 2. In an embodiment in which dynamic filtering block 904 performs spectral shaping and/or dispersion filtering, the degree of spectral shaping or dispersion filtering applied may be controlled by a measure of the amount of compression applied by compression logic 914 and/or ASP logic 916 or by a measure of the amount of digital headroom remaining before such compression will be applied.

In alternate implementations, the degree of spectral shaping or dispersion filtering applied may be a function of a long-term or average level of the far-end speech signal or as a function of the level of lower-frequency components of the far-end speech signal. The level of such lower-frequency components may be determined, for example, by passing the far-end speech signal through a low-pass filter that has a roughly inverse shape to a high-pass filter used by dynamic filtering block 904.

Second level estimator 906 is configured to determine an estimated level of the far-end speech signal after it has been processed by dynamic filtering block 906. This estimate is then provided to suppression logic 912, compression logic 914 and ASP logic 916 for use in calculations performed by those blocks.

AGC logic 908 is configured to compensate for variations in the level of the far-end speech signal, as estimated by first level estimator 902. For example, such variations may be due to variation of network connections, acoustic coupling, or the like. AGC logic 908 calculates a gain scaling factor that, when applied to the far-end speech signal, brings the far-end speech signal to a nominal signal level. AGC logic 908 may operate in a like manner to that described above in reference to AGC logic 222 of system 200 or in a manner to be described below in Section D.

AVB logic 910 is configured to calculate an additional gain to be applied to the far-end speech signal so as to maintain a minimum SNR between the level of the far-end speech signal (after application of the gain calculated by AGC logic 908) and the level of the near-end background noise. AVB logic 910 may operate in a like manner to that described above in reference to AVB logic 224 of system 220.

Suppression logic 912 is configured to apply an echo suppression algorithm to the far-end speech signal in order to attenuate the effects of acoustic echo on that signal. The output of suppression logic 912 is a loss to be applied to the far-end speech signal.

Compression logic 914 is configured to determine a time varying gain to be applied to the far-end speech signal to ensure that, after application of the gain calculated by AGC logic 908, the gain calculated by AVB logic 910, the gain calculated by suppression logic 912, and a gain associated with a user volume setting, the audio output waveform does not exceed (or exceeds by only a permissible amount) a digital saturation or clipping point of the telephony device.

ASP logic 916 is configured to adaptively determine a compression point (i.e., an offset from a maximum digital amplitude at which saturation occurs) below which the maximum amplitude of the far-end speech signal must be maintained in order to protect users of the telephony device from acoustic shock or discomfort. ASP logic 916 may thus be thought of as calculating an additional loss that must be applied to the far-end speech signal in addition to that determined by compression logic 914.

Volume application block 918 is configured to receive the far-end speech signal after processing by dynamic filtering block 904 and to apply the gains calculated by AGC logic 908, AVB logic 910, suppression logic 912, compression logic 914 and ASP logic 916, as well as a gain associated with a user volume, thereto.

Soft clipper 920 is configured to receive the audio signal output by volume application block 918 and apply soft clipping thereto. Soft clipper 920 operates by manipulating the dynamic range of the audio signal output by volume application block 918 such that the level of the signal does not exceed a soft clipping limit. The soft clipping limit may be less than a limit imposed by the compression logic 914/ASP logic 916. In accordance with such an embodiment, at higher volumes, the dynamic range of the audio signal output by volume application block 918 will exceed the soft clipping limit of soft clipper 920. This overdriving of soft clipper 920 will lead to some level of clipping distortion. However, through careful selection of the limit imposed by compression logic 914/ASP logic 916 and the soft clipping limit, the amount of clipping distortion can advantageously be held to an acceptable level while maintaining loudness. An example of the use of soft clipping subsequent to amplitude compression is described in previously-referenced U.S. patent application Ser. No. 12/109,017, the entirety of which is incorporated by reference herein.

D. Alternate AGC Logic Implementation

Figure 10:
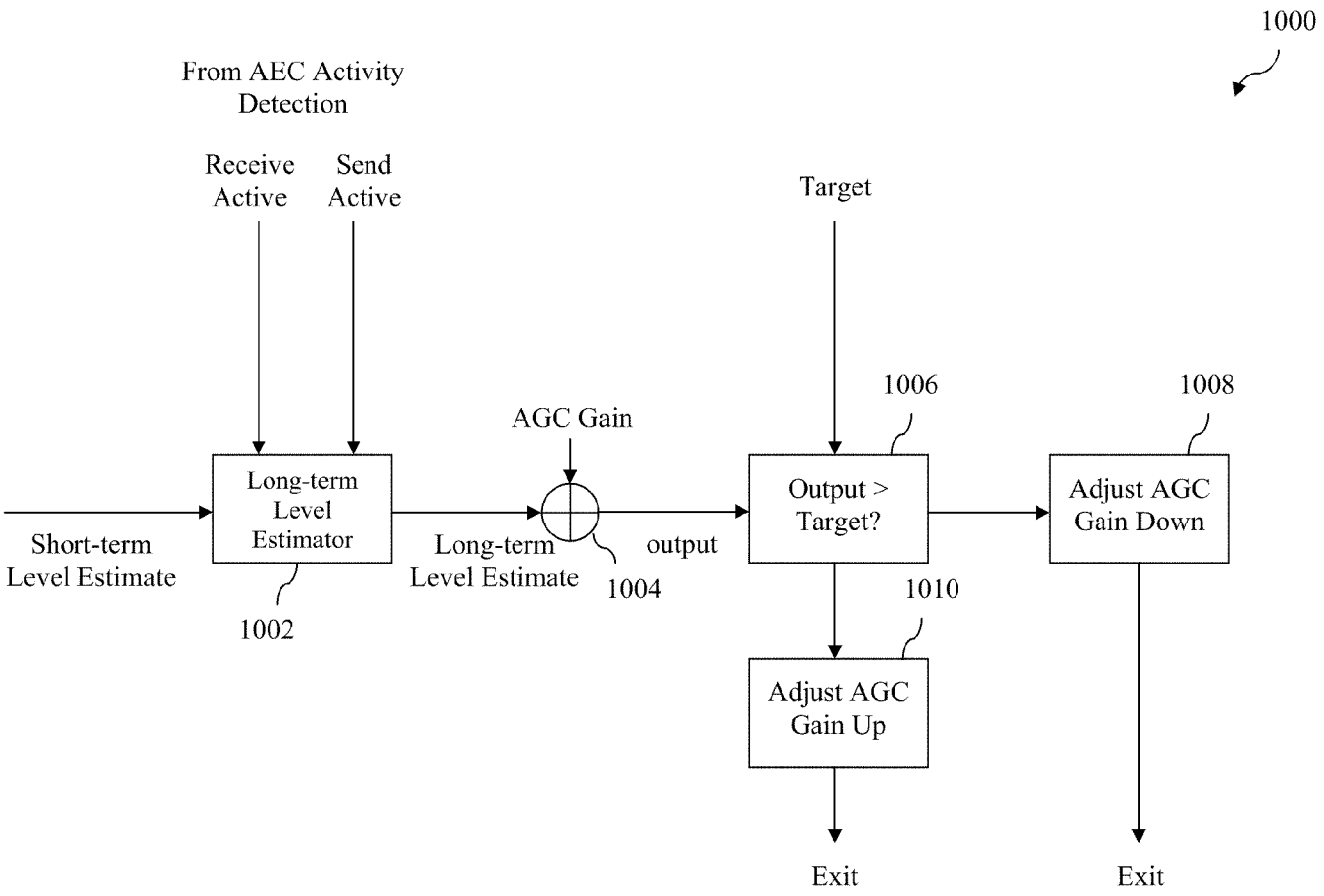
FIG. 10 is a block diagram of AGC logic that may be used to implement in an SIE system in accordance with an alternate embodiment of the present invention.

FIG. 10 is a block diagram of AGC logic 1000 that may be used to implement AGC logic 222 of SIE system 200 (described above in reference to FIG. 2) or AGC logic 908 of SIE system 900 (described above in reference to FIG. 9) in accordance with alternate embodiments of the present invention.

As shown in FIG. 10, AGC logic 1000 includes a long-term level estimator 1002. Long-term level estimator 1002 is configured to periodically receive a short-term estimate of the level of the far-end speech signal and to update a long-term estimate of the level of the far-end speech signal based on the short-term level estimate. With reference to system 900 of FIG. 9, the short-term level estimate may be received from level estimator 902.

A combiner 1004 is configured to receive the long-term level estimate generated by long-term level estimator 1002 and to add a current AGC gain thereto. The output of this operation is provided to decision logic 1006.

Decision logic 1006 determines whether or not the output of combiner 1004 exceeds a target level. If the output exceeds the target level, then a logic block 1008 operates to adjust the current AGC gain downward so that the target level can be maintained. Conversely, if the output does not exceed the target level, then a logic block 1010 operates to adjust the current AGC gain upward so that the target level can be maintained. Note that in certain embodiments, the target level may be a configurable parameter.

In an embodiment, long-term level estimator 1002 is also configured to receive a "receive active" signal from a sub-band acoustic echo canceler (SBAEC) that indicates whether or not the far-end speech signal constitutes active speech as well as a "send active" signal from the SBAEC that indicates whether or not a near-end speech signal to be transmitted to a far-end telephony device constitutes active speech. In a circumstance in which both the "receive active" and "send active" signals are asserted, long-term level estimator 1002 will not reduce the long-term level estimate it produces regardless of the short-term level estimates received (i.e., the long-term level estimate will not be allowed to adapt downward). The net result of this will be that the magnitude of the AGC gain will not be adapted upward even if the short-term level estimates are decreasing. This feature is intended to ensure that AGC logic 1000 does not operate to undo a loss that may be applied to the far-end speech signal by an echo suppressor when both the "receive active" and "send active" signals are asserted.

However, when both the "receive active" and "send active" signals are asserted, long-term level estimator 1002 will remain capable of increasing the long-term level estimate that it produces based on the short-term level estimates received (i.e., the long-term level estimate is allowed to adapt upward). This ensures that the AGC gain can still be adapted downward to maintain the target signal level if the far-end speech signal is too loud.

In an embodiment, AVB logic that operates in conjunction with AGC logic 1000 (e.g., AVB logic 224 of system 200 or AVB logic 910 of system 900) is configured to determine the amount of AVB gain to be applied to the far-end speech signal based also on a long-term level estimate that is not allowed to adapt downward when both the near-end speech signal and the far-end speech signal are determined to constitute active speech. This ensures that the AVB logic also does not operate to undo echo suppression that may have been applied to the far-end speech signal. However, the long-term level estimate used by the AVB logic is allowed to adapt upward when both the near-end speech signal and the far-end speech signal are determined to constitute active speech.

In a further embodiment, long-term level estimator 1002 is capable of determining whether the far-end speech signal constitutes tones or stationary (i.e., non-speech) signals based on an analysis of the short-term level estimate. In further accordance with such an embodiment, if it is determined that the far-end speech signal constitutes tones or stationary signals, long-term level estimator 1002 will prevent the long-term level estimate from adapting downward but allow the long-term level estimate to adapt upwards in a like-manner to that described above when both the when both the "receive active" and "send active" signals are asserted.

Note that in one implementation, the compression point used for applying amplitude compression (as previously described) can be made adaptive such that a different compression point is used when the "send active" signal is asserted (which may be indicative of doubletalk) or when the far-end speech signal is determined to constitute tones or stationary signals.

E. Example Integration with Sub-Band Acoustic Echo Canceler

Figure 11:
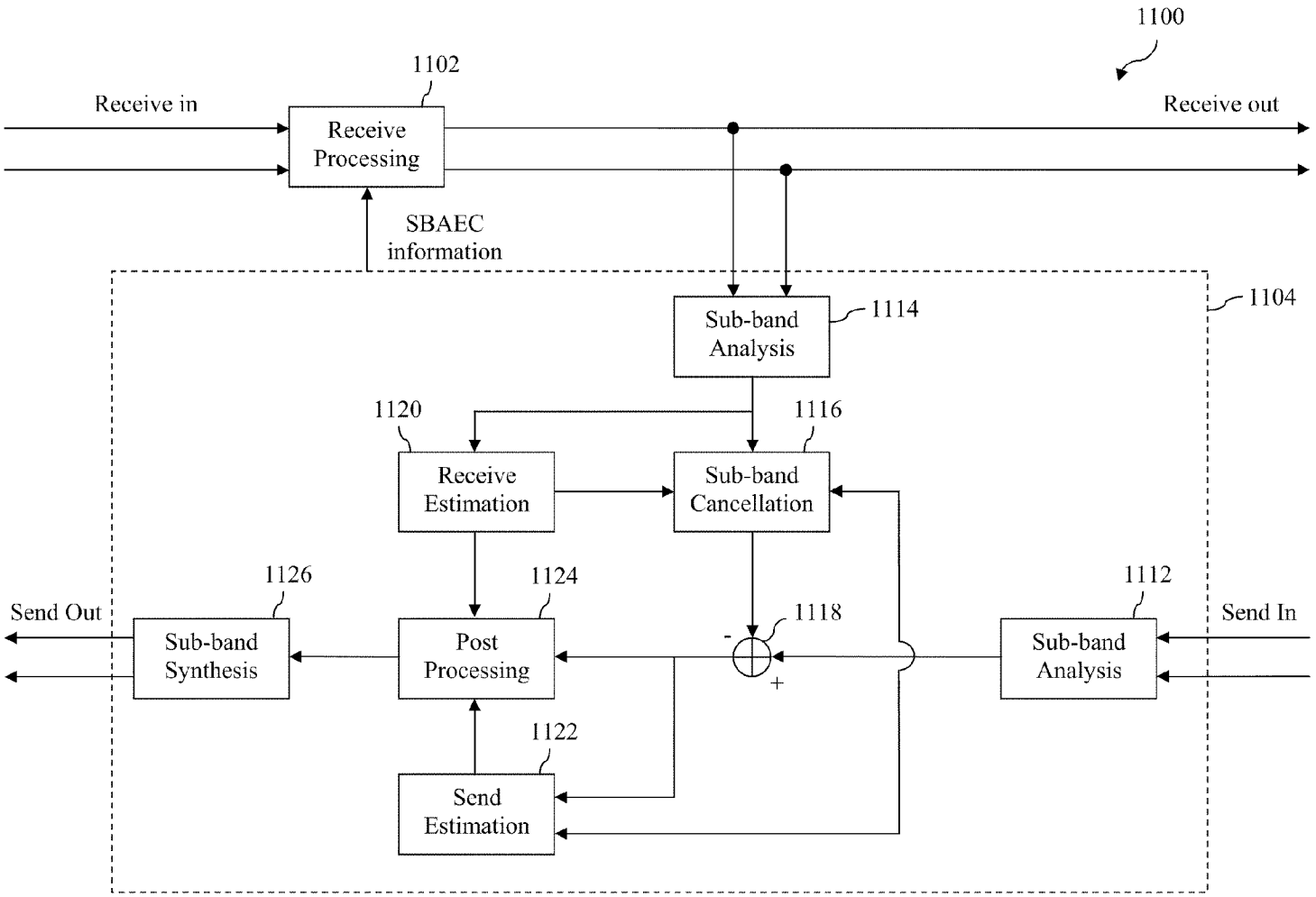
FIG. 11 is a block diagram that shows a telephony terminal in which an SIE system in accordance with an embodiment of the present invention is integrated with a sub-band acoustic canceler.

FIG. 11 is a block diagram that shows a telephony terminal 1100 in which an SIE system in accordance with an embodiment of the present invention is integrated with a sub-band acoustic canceler. As shown in FIG. 11, telephony terminal 1100 includes a receive processing block 1102 that is configured to improve the intelligibility of a speech signal received over a communication network from a far-end telephony terminal (the "far-end speech signal") for playback by telephony terminal 1100. In FIG. 11, the far-end speech signal is denoted "Receive in." The output of receive processing block 1102 is the modified far-end speech signal, denoted "Receive out." Receive processing block 1102 includes an SIE system in accordance with an embodiment of the present invention, such as SIE system 200 described above in reference to FIG. 2 or SIE system 900 described above in reference to FIG. 9.

As further shown in FIG. 11, telephony terminal 1100 includes a sub-band acoustic canceler 1104 that operates to cancel acoustic echo present in a speech signal captured by telephony terminal 1100 for transmission to the far-end telephony terminal over the communication network (the "near-end speech signal"). In FIG. 11, the near-end speech signal is denoted "Send in." The output of sub-band acoustic echo canceler 1104 is the modified near-end speech signal, denoted "Send out."

Sub-band acoustic canceler 1104 includes a number of components including a first sub-band analysis block 1112, a second sub-band analysis block 1114, a sub-band cancellation block 1116, a combiner 1118, a receive estimation block 1120, a send estimation block 1122, a post processing block 1124 and a sub-band synthesis block 1126. The operation of each of these components will now be described.

First sub-band analysis block 1112 is configured to receive a time-domain version of the near-end speech signal and to convert the signal into a plurality of frequency sub-band components. First sub-band analysis block 1112 may also down-sample the near-end speech signal as part of this process. Second sub-band analysis block 1114 is configured to receive a time-domain version of the modified far-end speech signal output by receive processing block 1102 and to convert the signal into a plurality of frequency sub-band components. First sub-band analysis block 1112 may also down-sample the near-end speech signal as part of this process.

Sub-band cancellation block 1116 receives the sub-band representation of the near-end speech signal and the modified far-end speech signal and operates to determine, on a sub-band by sub-band basis, components of the near-end speech signal that represent acoustic echo and thus should be cancelled from the signal. To perform this function, sub-band cancellation block 1116 analyzes the level of correlation between the near-end speech signal and the modified far-end speech signal. The sub-band echo components are provided to a combiner 1118 which operates to subtract the echo components from the near-end speech signal on a sub-band by sub-band basis.

Post processing block 1124 is configured to receive the signal output by combiner 1118 and to perform non-linear processing thereon to remove residual echo as well as to perform processing thereon to suppress noise present in the signal.

Sub-band synthesis block 1126 is configured to receive the output from post processing block 1124, which is represented as a plurality of frequency sub-band components, and to convert the plurality of sub-band components into a time domain representation of a modified version of the near-end speech signal. Sub-band synthesis block 1126 may also up-sample the modified version of the near-end speech signal as part of this process. The modified version of the near-end speech signal produced by sub-band synthesis block 1126 is then output for encoding and subsequent transmission to the far-end telephony terminal over the communication network.

Receive estimation block 1120 is configured to receive the sub-band components of the modified far-end speech signal and to estimate levels associated with each of the sub-bands that are used by sub-band cancellation block 1116 for performing acoustic echo cancellation functions and by post processing block 1124 for performing non-linear processing and noise suppression. The estimated levels may include, for example, an estimated level of a speech signal component present within each sub-band, an estimated level of a noise component present within each sub-band, or the like.

Send estimation block 1122 is configured to receive the sub-band components of the near-end speech signal after echo cancellation and to estimate levels associated with each of the sub-bands that are used by sub-band cancellation block 1116 for performing acoustic echo cancellation functions and by post processing block 1124 for performing non-linear processing and noise suppression. The estimated levels may include, for example, an estimated level of a speech signal component present within each sub-band, an estimated level of a noise component present within each sub-band, or the like.

In accordance with an embodiment of the present invention, sub-band acoustic canceler 1104 provides certain information generated during the performance of echo cancellation and noise suppression operations to receive processing block 1102. Receive processing block 1102 then uses such information to perform SIE operations. Such information will now be described.

In one embodiment, sub-band acoustic canceler 1104 provides a measure of voice activity in the far-end speech signal to one or more level estimator(s) in receive processing block 1102. The measure of voice activity may be used to control the level estimation function. The measure of voice activity may be determined, for example, by counting the number of sub-bands in which the energy significantly exceeds a noise floor. Because sub-band acoustic canceler 1104 analyzes the far-end speech signal in sub-bands, it is capable of providing a more accurate measure of voice activity than an analysis of a time-domain signal would provide.

In a further embodiment, sub-band acoustic canceler 1104 also provides a measure of voice activity in the near-end speech signal to one or more level estimator(s) in receive processing block. This measure of voice activity may also be used to control the level estimation function. For example, as described in Section D, above, AGC logic within receive processing block 1102 may use a measure of the voice activity in the far-end speech signal and in the near-end speech signal to prevent upward adaptation of a long-term level estimate when both the far-end speech signal and the near-end speech signal are deemed to constitute speech.

In another embodiment, sub-band acoustic canceler 1104 provides an estimate of the noise level present in the near-end speech signal to receive processing block 1102. For example, AVB logic within receive processing block 1102 may receive an estimate of the noise level present in the near-end speech signal from sub-band acoustic canceler 1104 and use this estimate to determine a far-end speech signal to near-end noise ratio as previously described.

Since sub-band acoustic canceler 1104 estimates noise levels on a frequency sub-band basis, the estimate of the noise level present in the near-end speech signal may be determined by assigning greater weight to certain sub-bands as opposed to others in order to ensure that the estimated noise level represents noise that would be perceptible to a human (in other words to ensure that the estimated noise level is a measure of the loudness of the noise as opposed to the intensity).

Furthermore, since sub-band acoustic canceler 1104 estimates noise levels on a frequency sub-band basis, sub-band acoustic canceler 1104 can provide the sub-band noise level estimates to a spectral shaping block within receive processing block 1102, such that spectral shaping may be performed as a function of the spectral shape of the noise. For example, different spectral shaping may be applied when the noise is white as opposed to flat.

It is noted that in FIG. 11, the speech signals denoted "Receive in," "Receive out," "Send in" and "Send out" are represented using two lines. This is intended to indicate that telephony terminal 1100 is capable of processing wideband speech signals (e.g., signals generated using 16 kHz sampling). In one embodiment of telephony terminal 1100, the far-end and near-end speech signals are wideband speech signals and are split into a narrowband component (e.g., 0-3.4 kHz, sampled at 8 kHz) and a wideband component (e.g., 3.4-7 kHz, sampled at 16 kHz). This approach makes the signal processing aspects of the terminal simpler from a wideband/narrowband perspective and enables functionality that is applicable only to narrowband speech signals to be implemented by processing only the narrowband component. Examples of systems that perform such split-band processing are described in U.S. Pat. Nos. 6,848,012, 6,928,495, 7,165,130, 7,283,585, 7,333,475 and 7,409,056 and U.S. patent application Ser. No. 11/672,120, the entireties of which are incorporated by reference herein.

In one embodiment, the SIE processing described above is applied only to a narrowband component of a wideband speech signal. In an alternate embodiment, the previously-described SIE processing is made applicable to wideband speech by also modifying the wideband component of a wideband speech signal. For example, in one embodiment, the gain of filters used to modify the far-end speech signal by receive processing block 1102 at 3.4 kHz (or 4 kHz) are extended across the wideband component. In slowly evolving spectral shaping, a table of the gain for the wideband component may be utilized, wherein the gain is a function of the narrowband filter. In one implementation, for rapidly evolving spectral shaping, the gain of the filter at 4 kHz is unity, so that there is no need to modify the wideband component.

The foregoing concept may also be extended to other sets of signal components sampled at various sampling rates, such as 8 kHz/16 kHz/48 kHz or 8 kHz/48 kHz.

Figure 12:
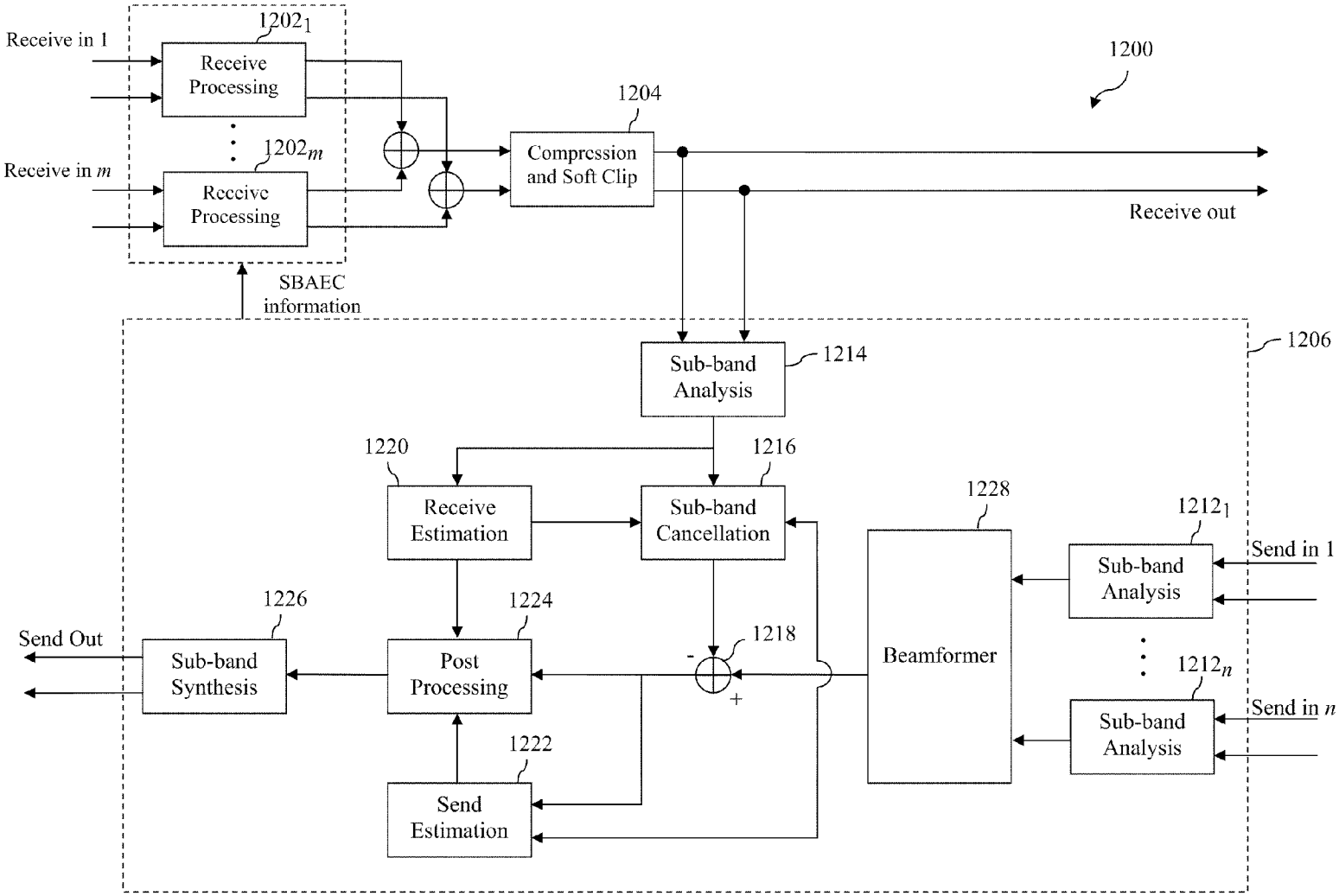
FIG. 12 is a block diagram that shows an alternate telephony terminal in which an SIE system in accordance with an embodiment of the present invention is integrated with a sub-band acoustic canceler.

FIG. 12 is a block diagram that shows an alternate telephony terminal 1200 in which an SIE system in accordance with an embodiment of the present invention is integrated with a sub-band acoustic canceler. Telephony terminal 1200 differs from telephony terminal 1100 in a variety of ways.

For example, telephony terminal 1200 is configured to receive a plurality of speech signals, denoted "Receive in" 1 through "Receive in" m, and to combine those signals to produce a single output speech signal denoted "Receive out." Each of the signals "Receive in" 1-*m* may comprise, for example and without limitation, a different far-end speech signal in a multi-party conference call or a different audio channel in a multi-channel audio signal.

As shown in FIG. 12, each "Receive in" signal 1-*m* is processed by a corresponding receive processing block $\mathbf{1202}_1$-$\mathbf{1202}_m$. Each receive processing block $\mathbf{1202}_1$-$\mathbf{1202}_m$ includes an SIE system in accordance with an embodiment of the present invention, such as SIE system 200 described above in reference to FIG. 2 or SIE system 900 described above in reference to FIG. 9, and operates to improve the intelligibility of a corresponding "Receive in" signal.

As further shown in FIG. 12, the output signals of receive processing blocks $\mathbf{1202}_1$-$\mathbf{1202}_m$ are combined prior to being received by a compression and soft clipping block 1204. By separately applying SIE to each "Receive in" signal prior to mixing, telephony terminal 1200 ensures that each "Receive in" signal is modified only to the extent necessary to achieve a desired intelligibility for that signal. In other words, by separately applying SIE to each "Receive in" signal, one "Receive in" signal need not be distorted to improve the intelligibility of another "Receive in" signal.

Compression and soft clipping logic 1204 is configured to apply amplitude compression and/or soft clipping to the signal produced by the combination of the outputs of receive processing blocks $\mathbf{1202}_1$-$\mathbf{1202}_m$. Such amplitude compression and/or soft clipping may be applied to ensure that the signal produced by the combination of the outputs of receive processing blocks $\mathbf{1202}_1$-$\mathbf{1202}_m$ does not exceed a digital saturation point or only exceeds the digital saturation point by a permissible amount. Note that in an alternate implementation, compression and soft clipping may be separately applied to each signal output from each of receive processing blocks $\mathbf{1202}_1$-$\mathbf{1202}_m$ and then further applied to the signal produced by the combination of those outputs.

As also shown in FIG. 12, telephony terminal 1200 includes a sub-band acoustic canceler 1204 that operates to cancel acoustic echo present in a near-end speech signal captured by telephony terminal 1200 for transmission to a far-end telephony terminal over a communication network. To capture the near-end speech signal, telephony terminal includes a plurality of microphones, each of which produces a different input speech signal. These input speech signals are denoted "Send in" 1 through "Send in" n. Each input speech signal "Send in" 1-*n* is converted from a time domain signal into a plurality of frequency sub-band components by a corresponding sub-band analysis block $\mathbf{1212}_1$-$\mathbf{1212}_m$. The output from sub-band analysis blocks $\mathbf{1212}_1$-$\mathbf{1212}_m$ are provided to a beamformer 1228 which performs spatial filtering operations on the output to attenuate unwanted undesired audio content. The output of beamformer 1228 is then treated as the near-end speech signal.

The remaining components of sub-band acoustic echo canceler 1206 operate in essentially the same manner as like-named components described above in reference to telephony terminal 1100 of FIG. 11. However, to perform an estimation of the level of the noise in the near-end speech signal, send estimation block 1222 may be configured to account for the noise-reducing effect of beamformer 1228. In other words, the noise level estimate provided by send estimation block 1222 may be an estimate of the noise level at one of the multiple microphones.

Sub-band acoustic canceler 1204 provides certain information generated during the performance of echo cancellation and noise suppression operations to receive processing blocks $\mathbf{1202}_1$-$\mathbf{1202}_m$. Each of receive processing blocks $\mathbf{1202}_1$-$\mathbf{1202}_m$ then uses such information to perform SIE operations. The information provided may include, for example and without limitation, a measure of voice activity in the far-end speech signal, a measure of voice activity in the near-end speech signal, or an estimate of the noise level present in the far-end speech signal.

In the implementation described above in reference to FIG. 12, a plurality of received speech signals "Receive in" 1-*m* are combined to produce a single "Receive out" speech signal. However, persons skilled in the relevant art(s) will readily appreciate that the present invention encompasses other implementations in which a one or more received speech are processed to produce a plurality of "Receive out" speech signals 1-*n*. For example, in an embodiment in which the invention is implemented in a stereo headset or a stereo Voice over IP Protocol (VoIP) telephone, one or more received speech signals may be processed to produce 2 channels of output audio. Depending upon the specific implementation, receive processing and/or compression/soft-clipping may be performed on each received speech signal as well as upon combinations of such received speech signals to produce the desired output signals.

F. Example Methods in Accordance with Embodiments of the Present Invention

Example methods for processing a speech signal for playback by an audio device in accordance with various embodiments of the present invention will now be described in reference to flowcharts depicted in FIGS. 13-21.

Figure 13:
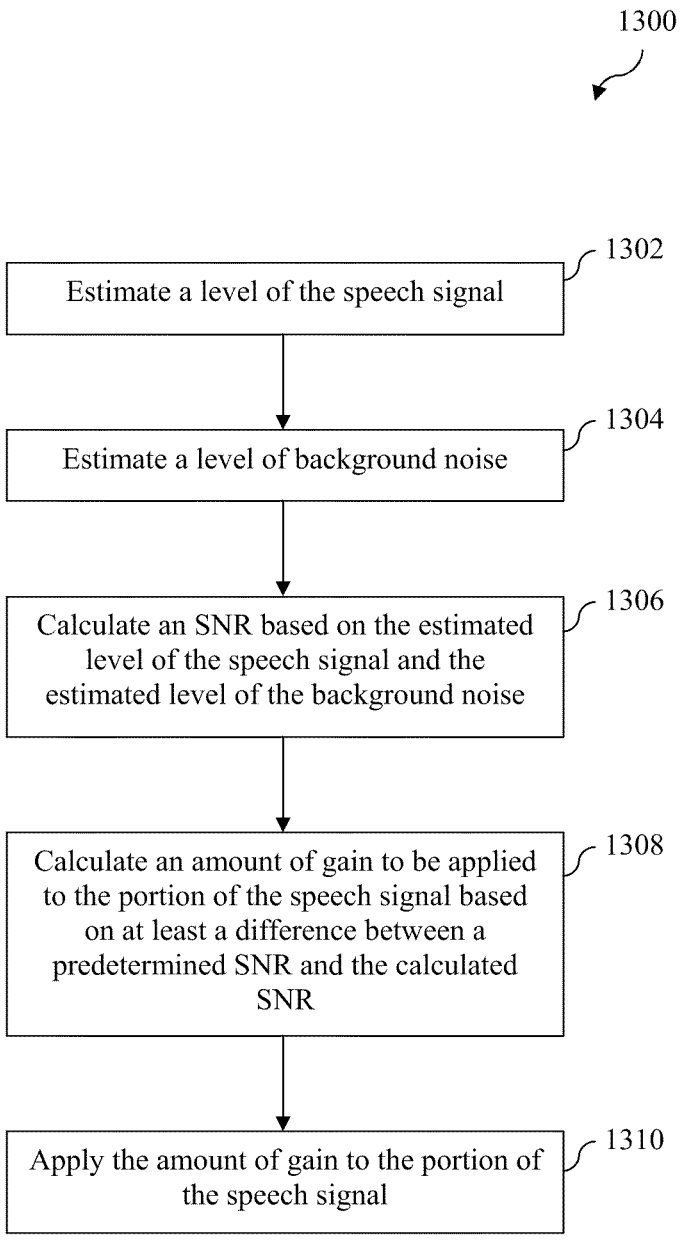
FIGS. 13-18 depict flowcharts of various methods for processing a portion of a speech signal to be played back by an audio device in accordance with embodiments of the present invention.

In particular, FIG. 13 depicts a flowchart 1300 of a method for processing a portion of a speech signal to be played back by an audio device in accordance with one embodiment of the present invention. As shown in FIG. 13, the method of flowchart 1300 begins at step 1302 in which a level of the speech signal is estimated. At step 1304, a level of background noise is estimated. At step 1306, a signal-to-noise ratio (SNR) is calculated based on the estimated level of the speech signal and the estimated level of the background noise. At step 1308, an amount of gain to be applied to the portion of the speech signal is calculated based on at least a difference between a predetermined SNR and the calculated SNR. At step 1310, the amount of gain is applied to the portion of the speech signal.

In one embodiment, performing step 1306 comprises calculating an automatic gain control (AGC) gain required to bring the estimated level of the speech signal to a predefined nominal level and then calculating the SNR based on the estimated level of the speech signal after application of the AGC gain thereto and the estimated level of the background noise. For example, as described elsewhere herein, this step may comprise calculating:

$$R2\text{Snoise}=\text{default_volume}+G_{AGC}+L_R+C-L_{Snoise},$$

wherein R2Snoise is the calculated SNR, default_volume is a constant representing a default volume, $G_{AGC}$ is the AGC gain, $L_R$ is the estimated level of the speech signal, $L_{Snoise}$ is the estimated level of the background noise and C is a calibration term.

In one embodiment, performing step 1308 comprises performing a number of steps. These steps include calculating a target gain as the difference between the predetermined SNR and the calculated SNR. Then, an actual gain is compared to the target gain, wherein the actual gain represents an amount of gain that was applied to a previously-received portion of the speech signal. If the target gain exceeds the actual gain by at least a fixed amount, then the amount of gain to be applied to the portion of the speech signal is calculated by adding the fixed amount of gain to the actual gain. However, if the target gain is less than the actual gain by at least the fixed amount, then the amount of gain to be applied to the portion of the speech signal is calculated by subtracting the fixed amount of gain from the actual gain.

In another embodiment, performing step 1308 comprises summing at least a user volume of the audio device, an amount of gain determined based on the difference between the predetermined SNR and the calculated SNR, and an amount of gain required to bring the estimated level of the speech signal to a predefined nominal level.

In a further embodiment, performing step 1308 comprises first calculating a desired gain to be applied to the portion of the speech signal based on at least the difference between the predetermined SNR and the calculated SNR. Then, a determination is made as to whether the application of the desired gain to the portion of the speech signal would cause a reference amplitude associated with the portion of the speech signal to exceed a predetermined amplitude limit. If it is determined that the application of the desired gain to the portion of the speech signal would cause the reference amplitude to exceed the predetermined amplitude limit, then an amount of gain to be applied to the portion of the speech signal is calculated that is less than the desired gain. For example, as described elsewhere herein, calculating an amount of gain to be applied to the portion of the speech signal that is less than the desired gain may comprise calculating $$G_{final}=\min[G_{desired}, G_{headroom}],$$

wherein $G_{final}$ is the amount of gain to be applied to the portion of the speech signal, $G_{desired}$ is the desired gain and $G_{headroom}$ is an estimate of the difference between the reference amplitude associated with the portion of the speech signal and the predetermined amplitude limit.

In further accordance with this embodiment, a difference may be calculated between the desired gain and the amount of gain to be applied to the portion of the speech signal. Spectral shaping may then be applied to at least one subsequently-received portion of the speech signal, wherein the degree of spectral shaping applied is based at least in part on the difference. Alternatively or additionally, dispersion filtering may be performed on at least one subsequently-received portion of the speech signal, wherein the degree of dispersion applied by the dispersion filtering is based at least in part on the difference.

Figure 14:
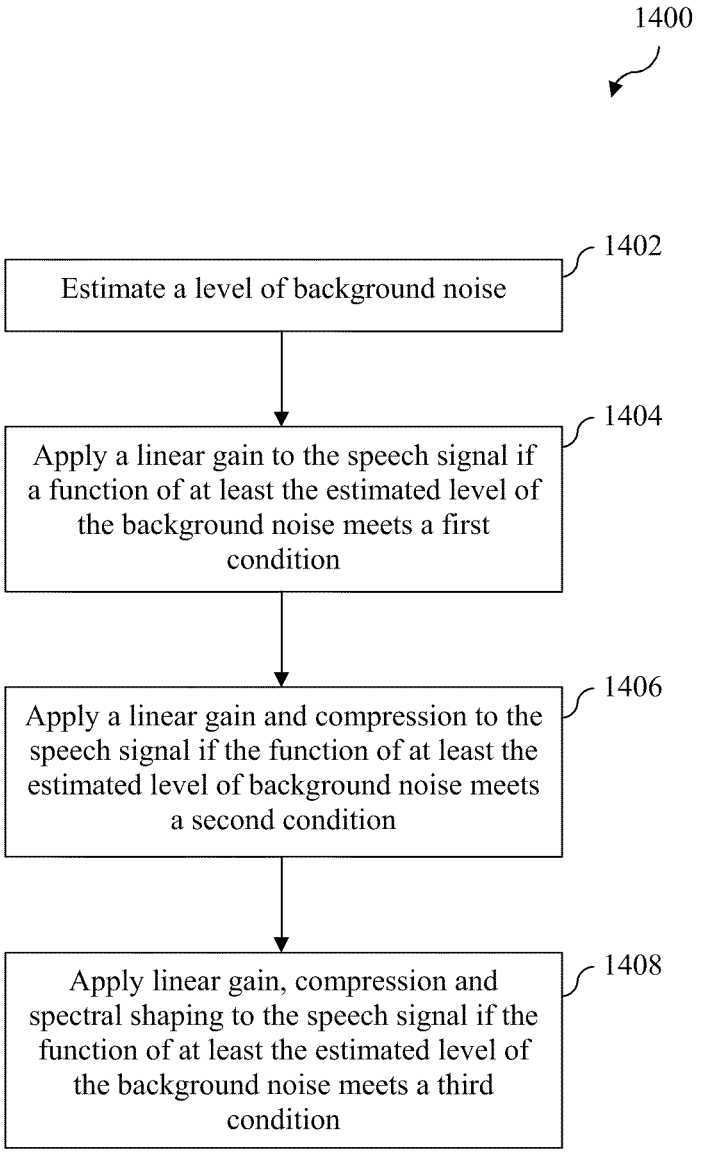

FIG. 14 depicts a flowchart 1400 of a method for processing a speech signal to be played back by an audio device in accordance with an embodiment of the present invention. As shown in FIG. 14, the method of flowchart 1400 begins at step 1402, in which a level of background noise is estimated. At step 1404, a linear gain is applied to the speech signal if a function of at least the estimated level of background noise meets a first condition. At step 1406, a linear gain and compression are applied to the speech signal if the function of at least the estimated level of the background noise meets a second condition. At step 1408, a linear gain, compression and spectral shaping are applied to the speech signal if the function of at least the estimated level of background noise meets a third condition.

In one embodiment, each of the first, second and third conditions is indicative of a need for a corresponding first, second and third degree of speech intelligibility enhancement, wherein the second degree is greater than the first degree and the third degree is greater than the second degree. The function based on at least the estimated level of background noise may comprise, for example, a signal-to-noise ratio (SNR) that is calculated based on an estimated level of the speech signal and the estimated level of the background noise.

Although it is not shown in FIG. 14, the method of flowchart 1400 may also include applying a linear, gain, compression and dispersion filtering to the speech signal if at least the estimated level of background noise meets a fourth condition.

Figure 15:
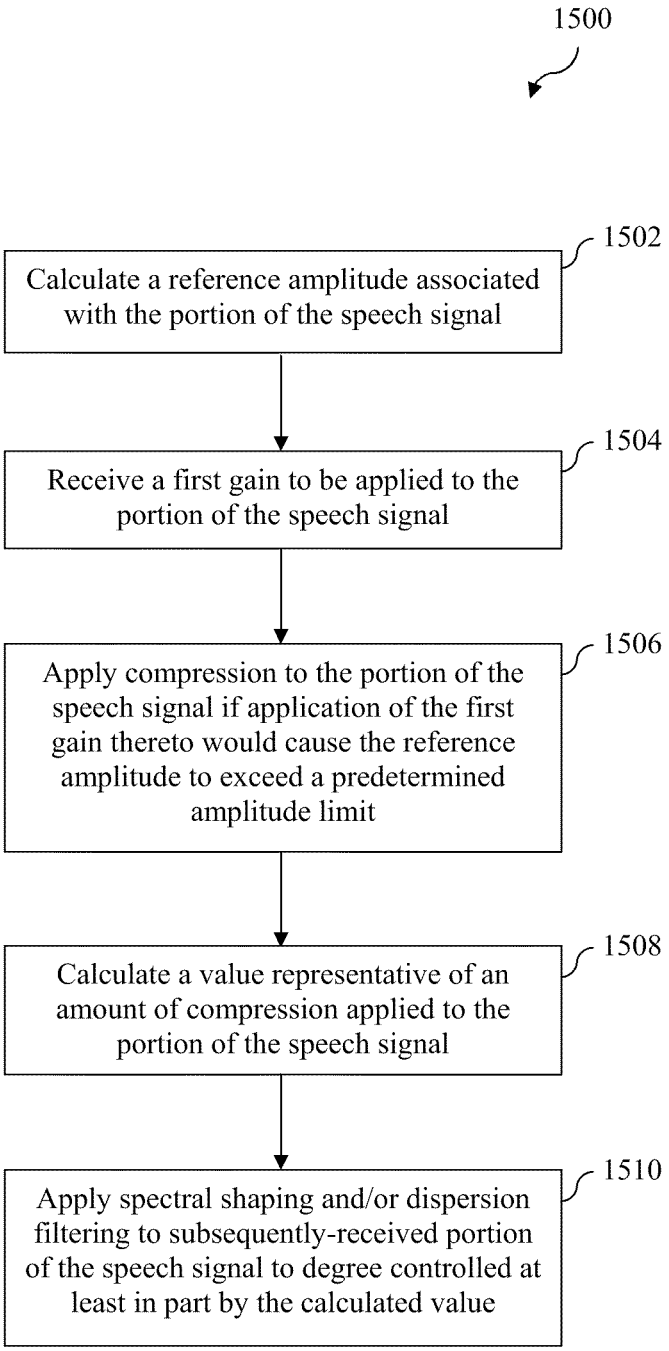

FIG. 15 depicts a flowchart 1500 of another method for processing a portion of a speech signal to be played back by an audio device in accordance with an embodiment of the present invention. As shown in FIG. 15, the method of flowchart 1500 begins at step 1502, in which a reference amplitude associated with the portion of the speech signal is calculated. In one embodiment, calculating the reference amplitude comprises determining a maximum absolute amplitude of the portion of the speech signal. In another embodiment, calculating the reference amplitude comprises determining a maximum absolute amplitude of a segment of the speech signal that includes the portion of the speech signal and one or more previously-processed portions of the speech signal. In a further embodiment, calculating the reference amplitude comprises setting the reference amplitude equal to the greater of a maximum absolute amplitude associated with the portion of the speech signal and a product of a reference amplitude associated with a previously-processed portion of the speech signal and a decay factor.

At step 1504, a first gain to be applied to the portion of the speech signal is received.

At step 1506, compression is applied to the portion of the speech signal if the application of the first gain to the portion of the speech signal would cause the reference amplitude associated with the portion of the speech signal to exceed a predetermined amplitude limit. In one embodiment, the predetermined amplitude limit comprises a maximum digital amplitude that can be used to represent the speech signal. In an alternate embodiment, the predetermined amplitude limit comprises an amplitude that is a predetermined number of decibels above or below a maximum digital amplitude that can be used to represent the speech signal.

The method of flowchart 1500 may further include adaptively calculating the predetermined amplitude limit. In one embodiment, adaptively calculating the predetermined amplitude limit comprises adaptively calculating the predetermined amplitude limit based at least on a user-selected volume.

Depending upon the implementation, the application of compression in step 1506 may include applying a second gain to the portion of the speech signal that is less than the first gain, wherein the second gain is calculated as an amount of gain required to bring the reference amplitude associated with the portion of the speech signal to the predetermined amplitude limit. As described previously herein, calculating the second gain may comprise calculating:

$$G_{headroom} = 20 \cdot \log_{10}\left(\frac{MAXAMPL}{mx(k)}\right) - G_{margin} - C_p$$

wherein $G_{headroom}$ is the second gain, MAXAMPL is a maximum digital amplitude that can be used to represent the speech signal, mx(k) is the reference amplitude associated with the portion of the speech signal, $G_{margin}$ is a predefined margin and $C_p$ is a predetermined number of decibels.

At step 1508, a value representative of an amount of compression applied to the portion of the speech signal during step 1506 is calculated. In one embodiment, calculating this value comprises calculating an instantaneous volume loss by determining a difference between the first gain and the second gain described in the previous paragraph and then calculating an average version of the instantaneous volume loss.

At step 1510, spectral shaping and/or dispersion filtering is applied to at least one subsequently-received portion of the speech signal wherein the degree of spectral shaping and/or dispersion filtering applied is controlled at least in part by the value calculated during step 1508.

Figure 16:
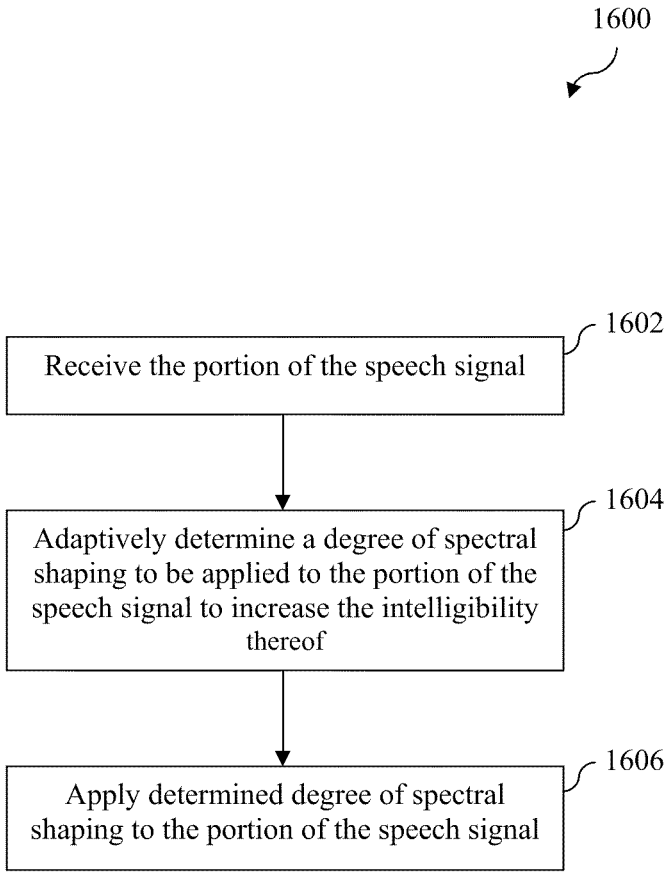

FIG. 16 depicts a flowchart 1600 of another method for processing a portion of a speech signal to be played back by an audio device in accordance with an embodiment of the present invention. As shown in FIG. 16, the method of flowchart 1600 begins at step 1602, at which a portion of the speech signal is received.

At step 1604, a degree of spectral shaping to be applied to the portion of the speech signal to increase the intelligibility thereof is adaptively determined. Various methods may be used to adaptively determine the degree of spectral shaping to be applied. For example, a degree of compression that was or is estimated to be applied to the speech signal may be determined and the degree of spectral shaping to be applied may be determined as a function of at least the degree of compression.

As another example, a level of the speech signal may be calculated and the degree of spectral shaping to be applied may be determined as a function of at least the level of the speech signal.

As still another example, a level of one or more sub-band components of the speech signal may be calculated and the degree of spectral shaping to be applied may be determined as a function of at least the level(s) of the sub-band component(s).

As a further example, a level of background noise may be estimated and the degree of spectral shaping to be applied may be determined as a function of at least the level of the background noise. Estimating the level of the background noise may comprise estimating a level of one or more sub-band components of the background noise and determining the degree of spectral shaping to be applied as a function of at least the estimated level of the background noise may comprise determining the degree of spectral shaping as a function of at least the level(s) of the sub-band component(s).

As a still further example, a spectral shape of the background noise may be determined and the degree of spectral shaping to be applied may be determined as a function of at least the spectral shape of the background noise.

At step 1606, the determined degree of spectral shaping is applied to the portion of the speech signal. Applying the determined degree of spectral shaping to the portion of the speech signal may comprise amplifying at least one selected formant associated with the portion of the speech signal relative to at least one other formant associated with the portion of the speech signal. For example, applying the determined degree of spectral shaping to the portion of the speech signal may comprise amplifying a second and third formant associated with the portion of the speech signal relative to a first formant associated with the portion of the speech signal.

In one embodiment, applying the determined degree of spectral shaping to the portion of the speech signal comprises performing time-domain filtering on the portion of the speech signal using an adaptive high-pass filter.

Performing time-domain filtering on the portion of the speech signal using an adaptive high-pass filter may comprise performing time-domain filtering on the portion of the speech signal using a first adaptive spectral shaping filter and a second adaptive spectral shaping filter, wherein the second adaptive spectral shaping filter is configured to adapt more rapidly than the first adaptive spectral shaping filter. For example, the first adaptive spectral shaping filter may have the form $$x(n)=r_{in}(n)-b\cdot r_{in}(n-1)$$

wherein x(n) is the output of the first adaptive spectral shaping filter, $r_{in}(n)$ is the input to the first adaptive spectral shaping filter, and b is a filter coefficient that increases as a degree of compression that was or is estimated to be applied to the speech signal increases. In further accordance with this example, the second adaptive spectral shaping filter may have the form:

$$y(n)=x(n)-c\cdot x(n-2)-c\cdot y(n-1)$$

wherein y(n) is the output of the second adaptive spectral shaping filter, x(n) is the input to the second adaptive spectral shaping filter and c is a control parameter. The control parameter c may be calculated based upon a degree of compression that was or is estimated to be applied to the speech signal. The control parameter c may also be calculated based upon a measure of a slope of a spectral envelope of the speech signal.

Alternatively, performing time-domain filtering on the portion of the speech signal using an adaptive high-pass filter may comprise using only the first adaptive spectral shaping filter described above or using only the second adaptive spectral shaping filter described above.

Figure 17:
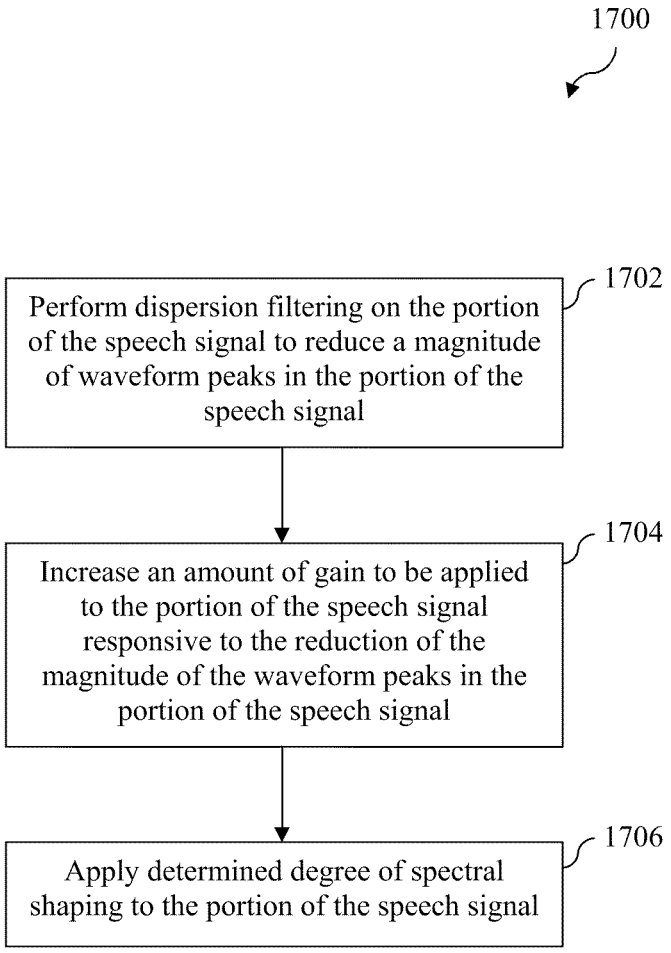

FIG. 17 depicts a flowchart 1700 of another method for processing a portion of a speech signal to be played back by an audio device in accordance with an embodiment of the present invention. As shown in FIG. 17, the method of flowchart 1700 begins at step 1702 in which dispersion filtering is performed on the portion of the speech signal to reduce a magnitude of waveform peaks in the portion of the speech signal. At step 1704, an amount of gain to be applied to the portion of the speech signal is increased responsive to the reduction of the magnitude of the waveform peaks in the portion of the speech signal.

In one embodiment, performing dispersion filtering on the portion of the speech signal as described in reference to step 1702 comprises reducing a peak-to-average ratio associated with the portion of the speech signal. Reducing a peak-to-average ratio associated with the portion of the speech signal may comprise, for example, reducing a peak-to-RMS ratio associated with the portion of the speech signal.

Performing dispersion filtering on the portion of the speech signal as described in reference to step 1702 may also comprise passing the portion of the speech signal through a fixed all-pass filter. The fixed all-pass filter may comprise, for example, a fixed sixth-order all-pass filter.

Alternatively, performing dispersion filtering on the portion of the speech signal as described in reference to step 1702 may comprise passing the portion of the speech signal through an adaptive all-pass filter. In accordance with such an embodiment, poles and zeros of the adaptive all-pass filter may be adapted based on local characteristics of the speech signal. For example, radii of the poles of the adaptive all-pass filter may be decreased during silence regions of the speech signal and increased during vowel regions of the speech signal. As another example, pole frequencies of the adaptive all-pass filter may be set to pole frequencies of a fixed all-pass filter during an initial portion of a voiced region of the speech signal and then the pole frequencies may be adapted during subsequent portions of the speech signal by tracking changes in the speech signal. Tracking changes in the speech signal may include estimating formant frequencies of the speech signal and guiding the adaptation of the pole frequencies of the all-pass filter based on the estimated formant frequencies. Tracking changes in the speech signal may also comprises performing a closed-loop pole frequency search to determine optimal pole frequencies and then guiding the adaptation of the pole frequencies of the all-pass filter based on the optimal pole frequencies. Performing the closed-loop pole frequency search to determine the optimal pole frequencies may comprise limiting the closed-loop pole frequency search to predefined search ranges around optimal pole frequencies associated with a previously-processed portion of the speech signal.

In another embodiment in which performing dispersion filtering on the portion of the speech signal comprises passing the portion of the speech signal through an adaptive all-pass filter, the adaptive all-pass filter may be adapted based on a value representative of an amount of compression applied to one or more previously-processed portions of the speech signal. Adapting the filter in this manner may include calculating a scaling factor based on the value representative of the amount of compression, wherein the scaling factor increases as the value increases, and then applying the scaling factor to radii of poles of the adaptive all-pass filter.

In a further embodiment, performing dispersion filtering on the portion of the speech signal as described in reference to step 1702 comprises passing the portion of the speech signal through an all-pass filter comprises selecting one of a collection of N all-pass filter candidates.

Figure 18:
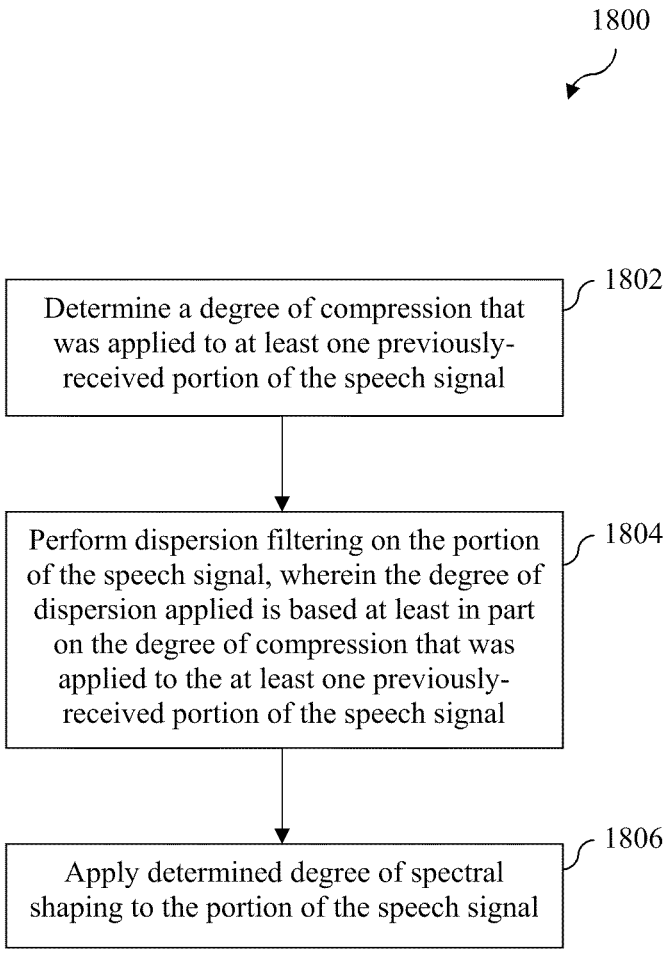

FIG. 18 depicts a flowchart 1800 of another method for processing a portion of a speech signal to be played back by an audio device in accordance with an embodiment of the present invention. As shown in FIG. 18, the method of flowchart 1800 starts at step 1802 in which a degree of compression that was applied to at least one previously-received portion of the speech signal is determined. At step 1804, dispersion filtering is performed on the portion of the speech signal, wherein the degree of dispersion applied by the dispersion filtering is based at least in part on the degree of compression that was applied to the at least one previously-received portion of the speech signal. Performing dispersion filtering in step 1804 may comprise, for example, passing the portion of the speech signal through an adaptive all-pass filter. The adaptive all-pass filter may be adapted based on a value representative of the degree of compression that was applied to the at least one previously-received portion of the speech signal. Adapting the filter in this manner may include calculating a scaling factor based on the value representative of the amount of compression, wherein the scaling factor increases as the value increases, and then applying the scaling factor to radii of poles of the adaptive all-pass filter.

Figure 19:
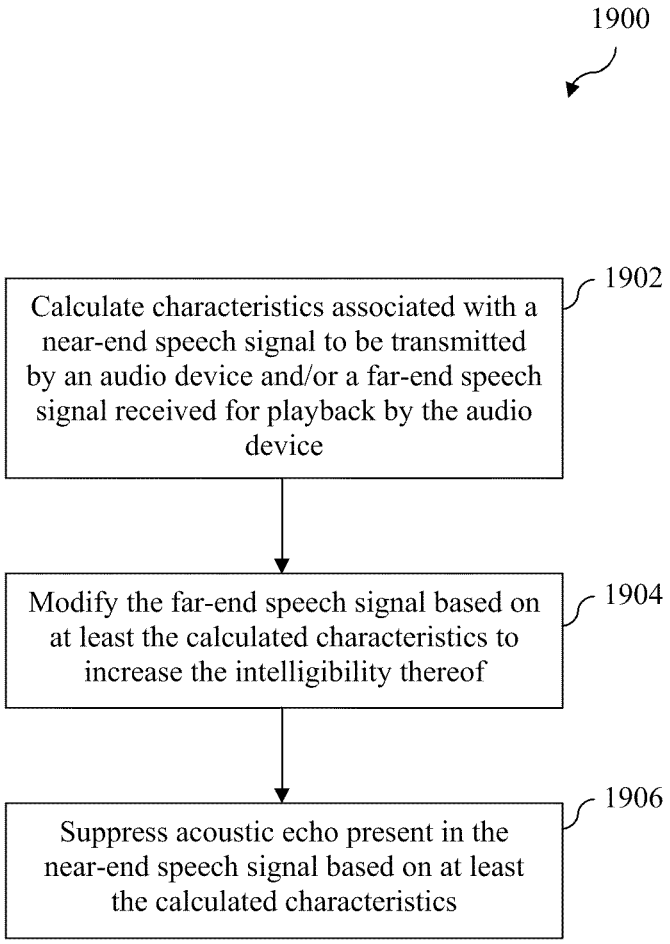
FIG. 19 depicts a flowchart of a method for operating an integrated speech intelligibility enhancement system and acoustic echo canceler in accordance with an embodiment of the present invention.

FIG. 19 depicts a flowchart 1900 of a method for operating an integrated speech intelligibility enhancement system and acoustic echo canceler in accordance with an embodiment of the present invention.

As shown in FIG. 19, the method of flowchart 1900 begins at step 1902 in which characteristics associated with a near-end speech signal to be transmitted by an audio device and/or a far-end speech signal received for playback by the audio device are calculated. Calculating the characteristics may include, for example, calculating an estimated level of background noise associated with the near-end speech signal. Calculating the estimated level of background noise associated with the near-end speech signal may include calculating an estimated level of background noise corresponding to each of a plurality of sub-band components of the near-end speech signal. Alternatively, calculating the estimated level of background noise associated with the near-end speech signal may comprise calculating a measure of loudness by applying a weight to one or more estimated levels of background noise corresponding to one or more sub-band components of the near-end speech signal.

At step 1904, the far-end speech signal is modified based on at least the calculated characteristics to increase the intelligibility thereof. In an embodiment in which the calculated characteristics comprise one or more estimated levels of background noise corresponding to one or more sub-band components of the near-end speech signal, this step may comprise performing spectral shaping on the far-end speech signal based on one or more of the estimated levels of background noise corresponding to one or more of the sub-band components.

At step 1906, acoustic echo present in the near-end speech signal is suppressed based on at least the calculated characteristics.

In one embodiment of the method of flowchart 1900, calculating characteristics in step 1902 comprises determining whether voice activity is present in the far-end speech signal and modifying the far-end speech signal in step 1904 comprises controlling the operation of a level estimator based on the determination, wherein the level estimator calculates an estimated signal level associated with the far-end speech signal, and applying a gain to the far-end speech signal wherein the amount of gain applied is based on the estimated signal level. Determining whether voice activity is present in the far-end speech signal may comprise analyzing one or more sub-band components of the far-end speech signal.

In another embodiment of the method of flowchart 1900, calculating characteristics in step 1902 comprises determining whether voice activity is present in the near-end speech signal and modifying the far-end speech signal in step 1904 comprises controlling the operation of a level estimator based on the determination, wherein the level estimator calculates an estimated signal level associated with the far-end speech signal, and applying a gain to the far-end speech signal wherein the amount of gain applied is based on the estimated signal level. Determining whether voice activity is present in the near-end speech signal may comprise analyzing one or more sub-band components of the near-end speech signal.

In a further embodiment of the method of flowchart 1900, calculating characteristics in step 1902 comprises calculating the estimated level of background noise at one or more microphones in a plurality of microphones associated with the audio device. Calculating the estimated level of background noise at one or more microphones in the plurality of microphones associated with the audio device may comprise modifying an estimated level of background noise associated with the near-end speech signal to account for a noise changing effect produced by a beamformer coupled to the plurality of microphones.

Figure 20:
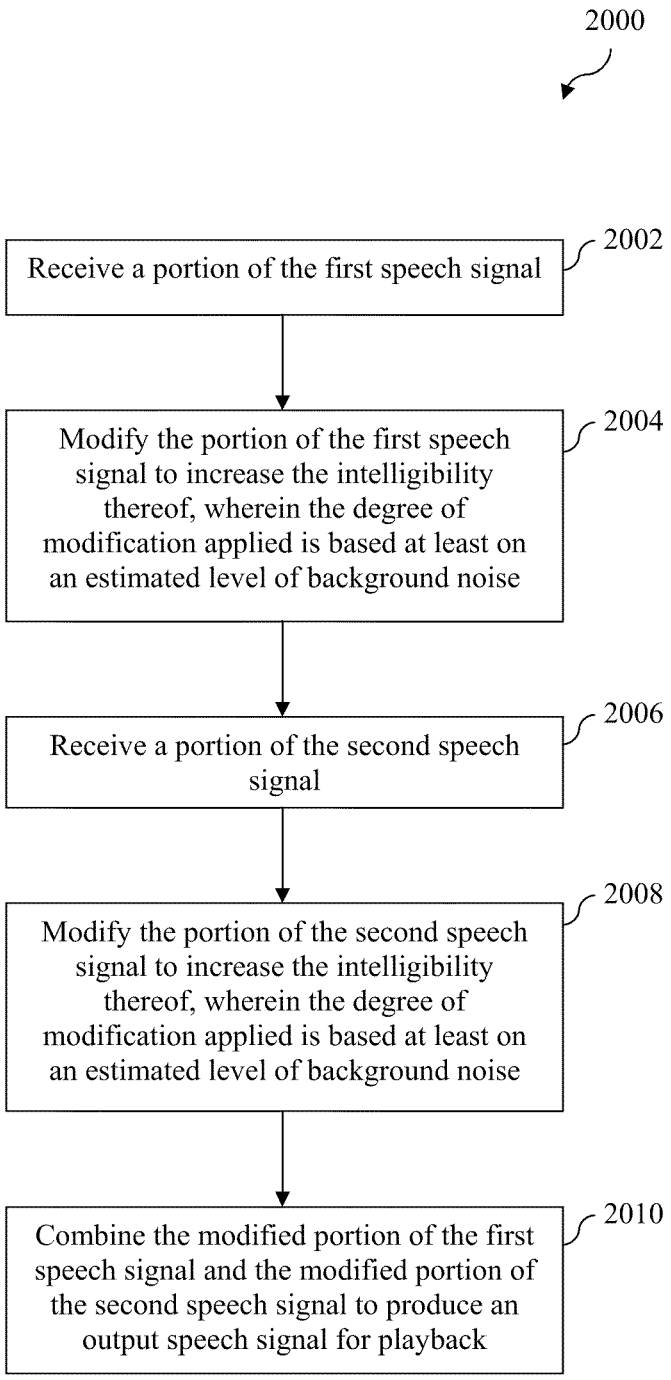
FIG. 20 depicts a flowchart of a method for processing first and second speech signals to produce an output speech signal for playback in accordance with an embodiment of the present invention.

FIG. 20 depicts a flowchart 2000 of a method for processing first and second speech signals to produce an output speech signal for playback in accordance with an embodiment of the present invention. As shown in FIG. 20, the method of flowchart 2000 begins at step 2002 in which a portion of the first speech signal is received.

At step 2004, the portion of the first speech signal is modified to increase the intelligibility thereof, wherein the degree of modification applied to the portion of the first speech signal is based at least on an estimated level of background noise.

At step 2006, a portion of the second speech signal is received.

At step 2008, the portion of the second speech signal is modified to increase the intelligibility thereof, wherein the degree of modification applied to the portion of the second speech signal is based at least on an estimated level of background noise.

At step 2010, the modified portion of the first speech signal and the modified portion of the second speech signal to produce an output speech signal for playback.

The foregoing method of flowchart 2000 may further include applying amplitude compression to the output speech signal and/or applying soft clipping to the output speech signal. In the foregoing method of flowchart 2000, step 2004 may include applying compression to the portion of the first speech signal to produce the modified portion of the first speech signal and/or applying soft clipping to the portion of the first speech signal to produce the modified portion of the first speech signal. Likewise, step 2008 may include applying compression to the portion of the second speech signal to produce the modified portion of the second speech signal and/or applying soft clipping to the portion of the second speech signal to produce the modified portion of the second speech signal.

Figure 21:
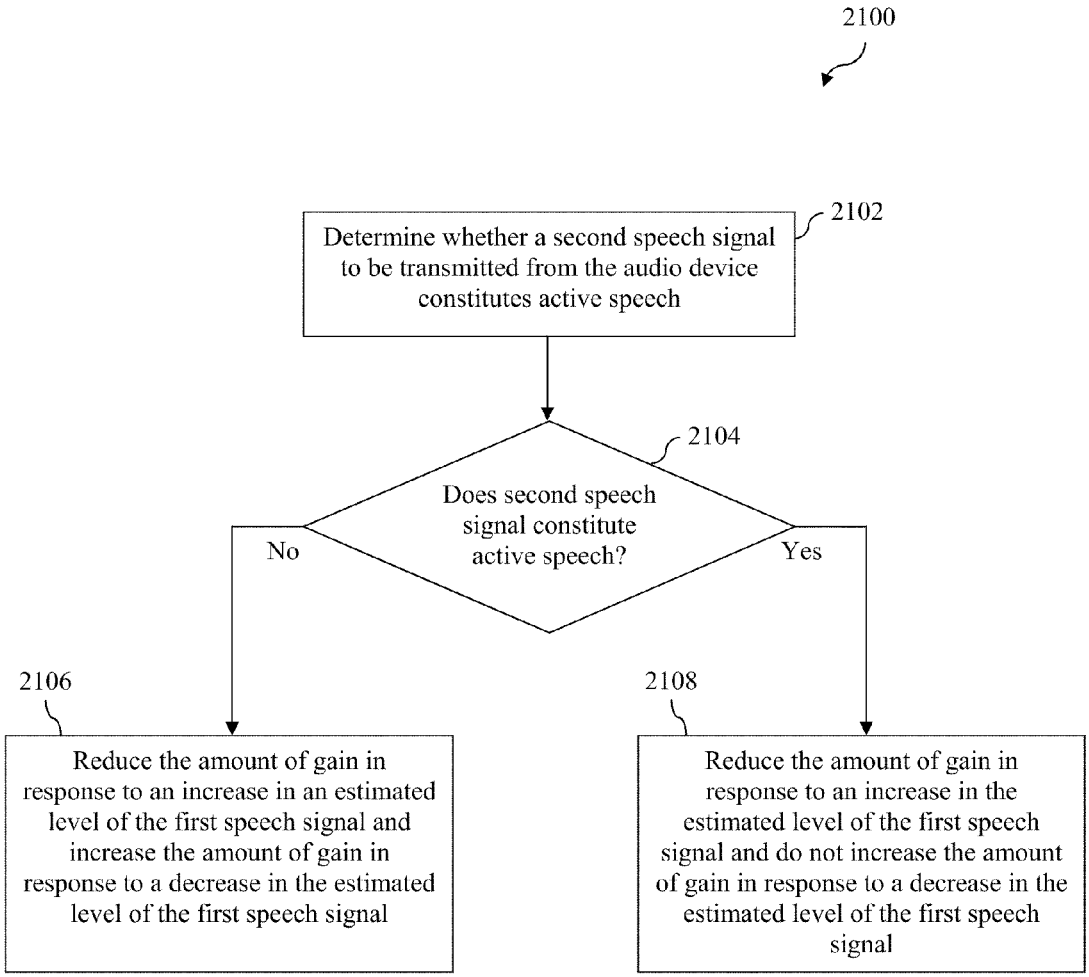
FIG. 21 depicts a flowchart of a method for updating an amount of gain to be applied to a first speech signal received for playback by an audio device in accordance with an embodiment of the present invention.

FIG. 21 depicts a flowchart 2100 of a method for updating an amount of gain to be applied to a first speech signal received for playback by an audio device in accordance with an embodiment of the present invention. As shown in FIG. 21, the method of flowchart 2100 begins at step 2102 in which it is determined whether a second speech signal to be transmitted from the audio device constitutes active speech. The results of the determination are analyzed during decision step 2104.

If it is determined during decision step 2104 that the second speech signal does not constitute active speech, then the amount of gain is reduced in response to an increase in an estimated level of the first speech signal and the amount of gain is increased in response to a decrease in the estimated level of the first speech signal as shown at step 2106. However, if it is determined during decision step 2104 that the second speech signal does constitute active speech, then the amount of gain is reduced in response to an increase in the estimated level of the first speech signal and the amount of gain is not increased in response to a decrease in the estimated level of the first speech signal as shown at step 2108.

The method of flowchart 2100 may further include updating the estimated level of the first speech signal. Updating the estimated level of the first speech signal may include calculating a short-term estimate of the level of the first speech signal based on a received portion of the first speech signal and then updating a long-term estimate of the level of the first speech signal based on the short-term estimate. In accordance with such an embodiment, performing step 2108 of flowchart 2100 may comprise not decreasing the long-term estimate of the level of the first speech signal responsive to a decrease in the short-term estimate of the level of the first speech signal.

The method of flowchart 2100 may further include determining whether the first speech signal constitutes a tone and performing step 2108 responsive also to determining that the first speech signal constitutes a tone. The method of flowchart 2100 may still further include determining whether the first speech signal constitutes a stationary signal and performing step 2108 responsive also to determining that the first speech signal constitutes a stationary signal.

Figure 22:
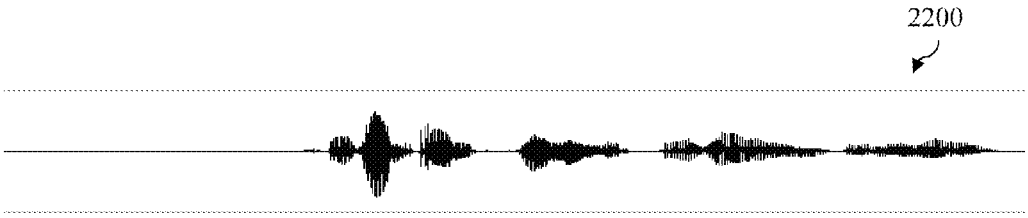
FIG. 22 depicts a waveform plot of an exemplary far-end speech signal that may be processed by an SIE system in accordance with an embodiment of the present invention.

G. Example Waveforms Generated by Speech Intelligibility Enhancement System and Method in Accordance with Embodiments of the Present Invention FIG. 22 depicts a waveform plot 2200 of an exemplary far-end speech signal that may be processed by SIE system 200 as described above in reference to FIG. 2. For example, the far-end speech signal shown in plot 2200 may be the "Receive-in" signal that is received by spectral shaping block 202 in SIE system 200. In further accordance with this example, FIGS. 23, 24 and 25 depict waveform plots of corresponding output speech signals that may be produced by SIE system 200 responsive to processing the far-end speech signal shown in plot 2200 at different levels of ambient background noise.

Figure 23:
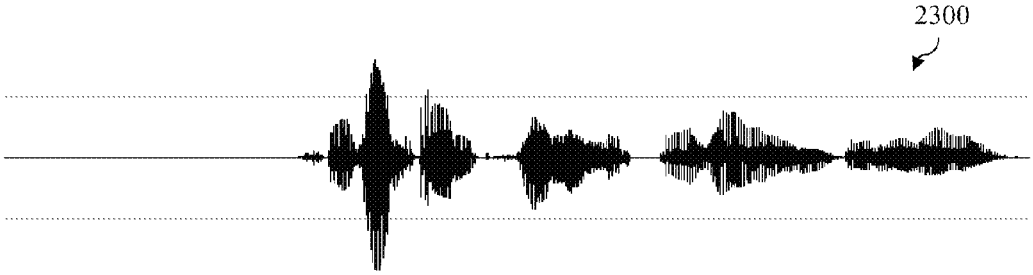
FIG. 23 depicts a waveform plot of a first output speech signal produced by an SIE system in accordance with an embodiment of the present invention.

In particular, FIG. 23 depicts a waveform plot 2300 of a corresponding output speech signal produced by SIE system 200 when the level of ambient background noise is sufficient to trigger the application of AVB (i.e., when the level of ambient background noise is such that the far-end speech signal to near-end background noise ratio is less than the target minimum SNR even after the application of AGC) but is not sufficient to trigger amplitude compression. As shown in waveform plot 2300, a pure linear gain has been applied to the far-end speech signal, thus resulting in a waveform having increased amplitude and loudness.

Figure 24:
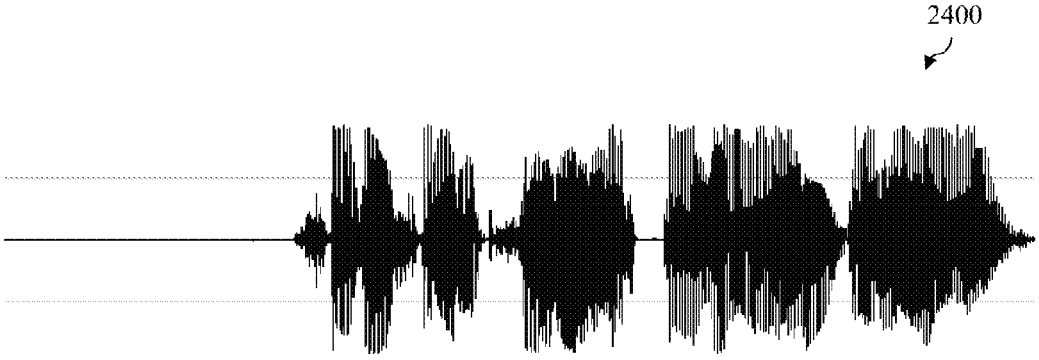
FIG. 24 depicts a waveform plot of a second output speech signal produced by an SIE system in accordance with an embodiment of the present invention.

FIG. 24 depicts a waveform plot 2400 of a corresponding output speech signal produced by SIE system 200 when the ambient background noise has increased to a level such that amplitude compression is applied to the far-end speech signal. Amplitude compression is used to allow for application of the full AVB gain necessary to reach the target SNR without digital saturation or clipping. As shown in plot 2400, to accommodate the application of an increased AVB gain, the high-amplitude regions of the far-end speech signal have been compressed relative to the low-amplitude regions.

Figure 25:
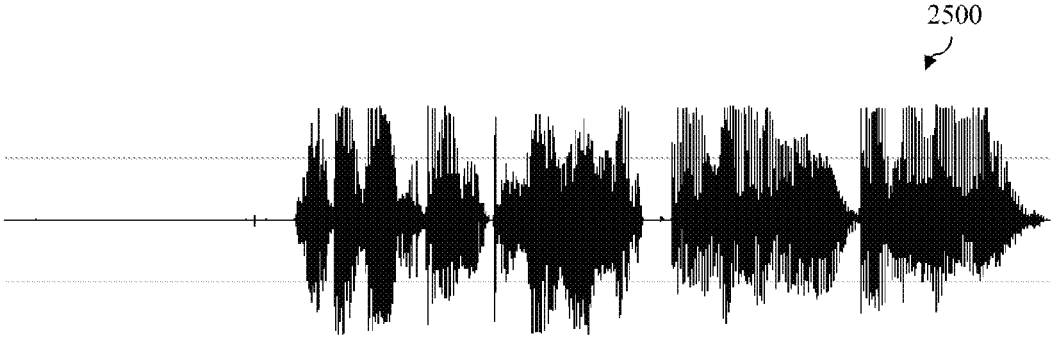
FIG. 25 depicts a waveform plot of a third output speech signal produced by an SIE system in accordance with an embodiment of the present invention.

FIG. 25 depicts a waveform plot 2500 of a corresponding output speech signal produced by SIE system 200 when the amount of amplitude compression applied due to background noise has increased to such a level that spectral shaping is applied to the far-end speech signal to preserve intelligibility. Spectral shaping operates to boost certain formants of the spectral envelope of the far-end speech signal above the near-end noise floor to make the far-end speech signal more intelligible. In one embodiment, the second and third formants of the far-end speech signal are boosted relative to the first formant since the second and third formants are more important from the perspective of speech intelligibility than the first formant.

Figure 26:
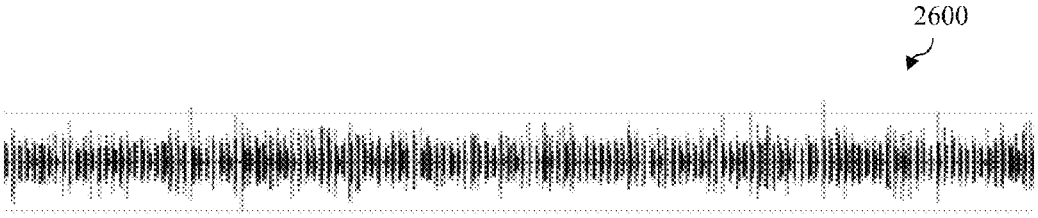
FIG. 26 is a waveform plot of an exemplary far-end speech signal that may be processed by an SIE system in accordance with an embodiment of the present invention.
Figure 27:
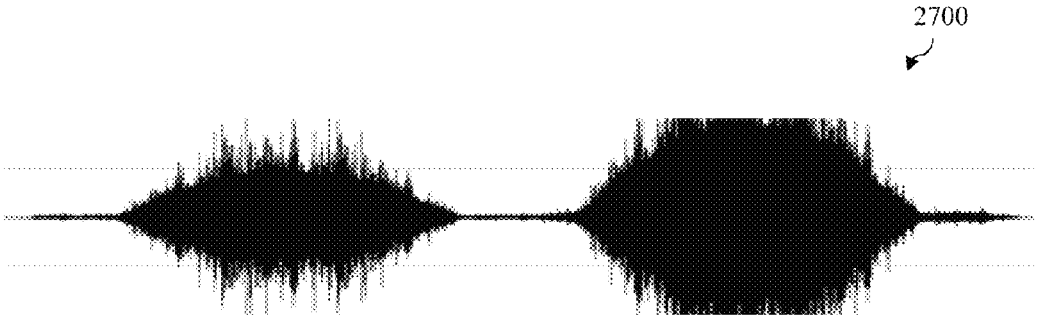
FIG. 27 is a waveform plot of exemplary ambient background noise present in an environment in which a telephony device that includes an SIE system in accordance with an embodiment of the present invention is being used.
Figure 28:
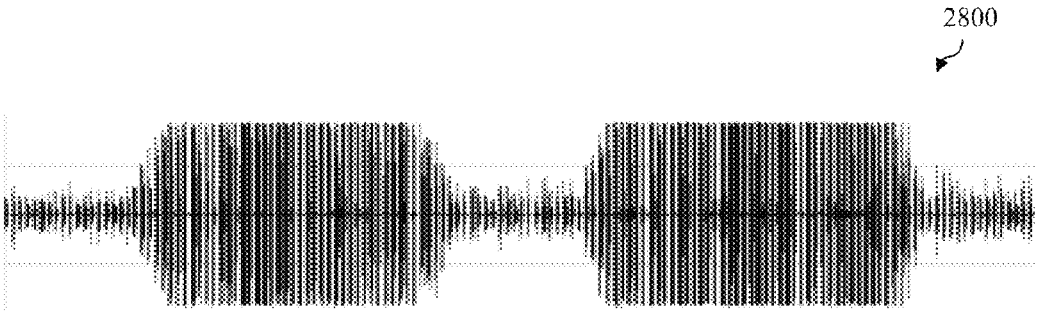
FIG. 28 is a waveform plot of an output speech signal produced by an SIE system in accordance with an embodiment of the present invention responsive to processing the far-end speech signal depicted in the waveform plot of FIG. 13 and the near-end background noise depicted in the waveform plot of FIG. 14.

A further example of the operation of SIE system 200 will now be described in reference to waveform plots shown in FIGS. 26-30. In particular, FIG. 26 is a waveform plot 2600 of an exemplary far-end speech signal that may be received over a communication network and processed by SIE system 200. FIG. 27 is a waveform plot 2700 of exemplary ambient background noise present in the environment in which the telephony terminal that includes SIE system 200 is being used. FIG. 28 is a waveform plot 2800 of an output speech signal produced by SIE system 200 responsive to processing the far-end speech signal depicted in plot 2600 of FIG. 26 and the near-end background noise depicted in plot 2700 of FIG. 27. As shown in plot 2800, SIE system 200 has boosted the portions of the far-end speech signal that coincide in time with the near-end background noise with the intent to achieve a minimum target far-end speech signal to near-end background noise ratio.

Figure 29:
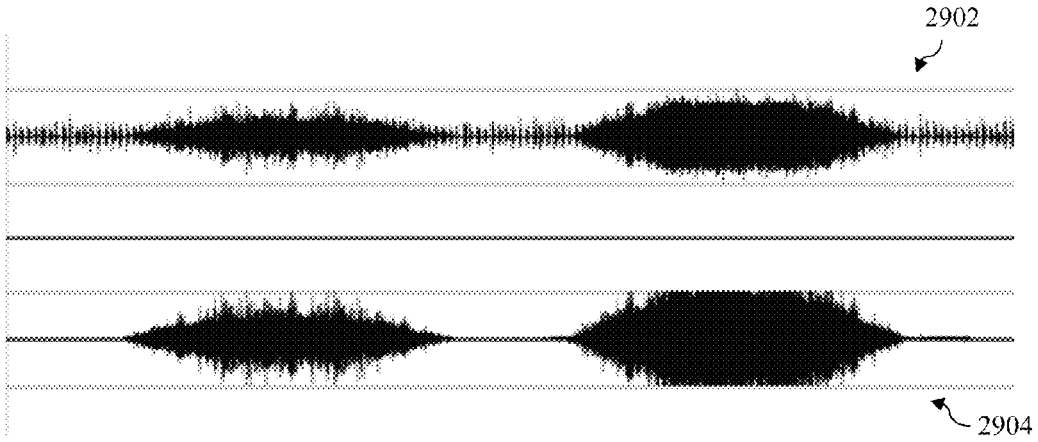
FIG. 29 depicts waveform plots of audio content presented to the right and left ear of a user to simulate and illustrate the effect of a telephony device that does not include an SIE system in accordance with an embodiment of the present invention.

Assume that a user is using a telephony device that does not include SIE system 200 to play back the far-end speech signal plotted in FIG. 26 in the context of the ambient background noise plotted in FIG. 27. Further assume that the telephony device includes a single loudspeaker that is housed in an ear bud which is inserted in the left ear of the user. In accordance with this example, FIG. 29 depicts a first waveform plot 2902 that represents the audio content presented to the left ear of the user and a second waveform plot 2904 that represents the audio content presented to the right ear of the user. As shown in FIG. 29, the right ear of the user is presented with only the ambient background noise while the left ear of the user is presented with the far-end speech signal plus the ambient background noise in order to simulate and illustrate the experience of a user in a noisy environment with a telephony device on the left ear. In this example, much of the far-end speech will be unintelligible to the user due to the relative magnitude of the ambient background noise. It is noted that due to a seal between the ear bud and the left ear of the user, the magnitude of the ambient background noise presented to the left ear is less than that presented to the right.

Figure 30:
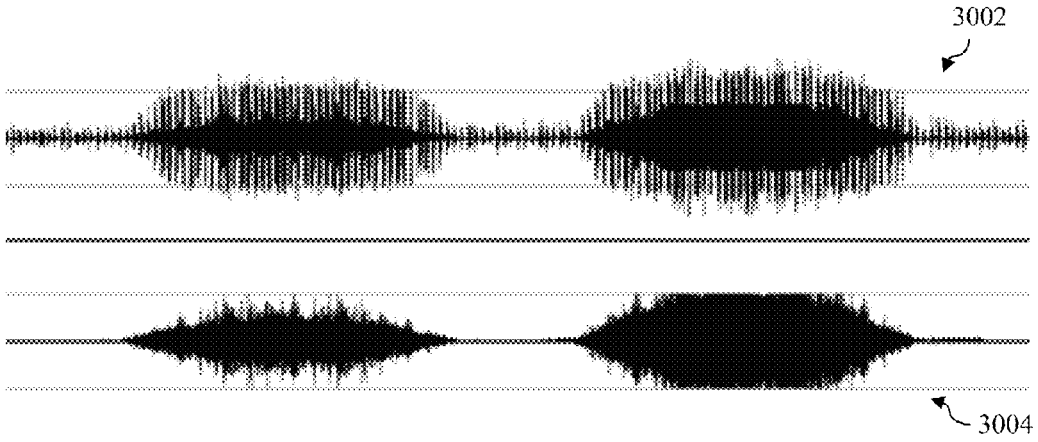
FIG. 30 depicts waveform plots of audio content presented to the right and left ear of a user to simulate and illustrate the effect of a telephony device that includes an SIE system in accordance with an embodiment of the present invention.

In contrast, now assume that the user is using a telephony device that does include SIE system 200 to play back the far-end speech signal plotted in FIG. 26 in the context of the ambient background noise plotted in FIG. 27. Further assume that the telephony device includes a single loudspeaker that is housed in an ear bud which is inserted in the left ear of the user. In accordance with this example, FIG. 30 depicts a first waveform plot 3002 that represents the audio content presented to the left ear of the user and a second waveform plot 3004 that represents the audio content presented to the right ear of the user. As shown in FIG. 30, the right ear of the user is presented only the ambient background noise while the left ear of the user is presented with the SIE processed version of the far-end speech signal (shown in FIG. 28) plus the ambient background noise in order to simulate and illustrate the experience of a user in a noisy environment with an SIE enabled telephony device on the left ear. In this example, it can be seen from FIG. 30 how the SIE is able to successfully process the speech signal so that it stands out from the background noise. Here again, it is noted that due to a seal between the ear bud and the left ear of the user, the magnitude of the ambient background noise presented to the left ear is less than that presented to the right. It should be noted that duration of the waveforms in FIG. 26 through FIG. 30 is approximately 9 minutes and 30 seconds, and the two highly noisy segments are each of approximately 3 minutes duration.

H. Example Computer System Implementations

It will be apparent to persons skilled in the relevant art(s) that various elements and features of the present invention, as described herein, may be implemented in hardware using analog and/or digital circuits, in software, through the execution of instructions by one or more general purpose or special-purpose processors, or as a combination of hardware and software.

Figure 31:
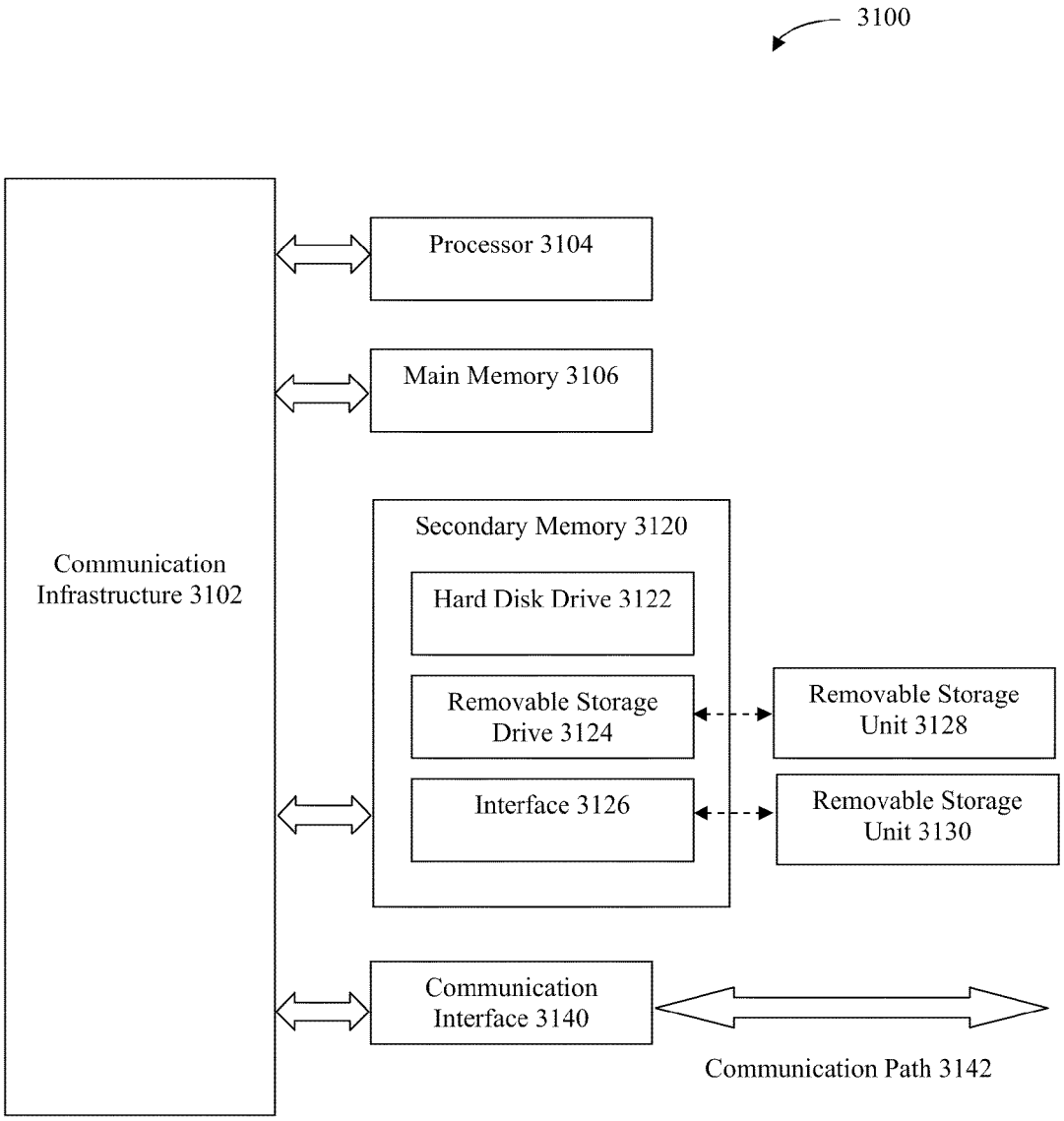
FIG. 31 is a block diagram of an example computer system that may be configured to implement an embodiment of the present invention.

The following description of a general purpose computer system is provided for the sake of completeness. Embodiments of the present invention can be implemented in hardware, or as a combination of software and hardware. Consequently, embodiments of the invention may be implemented in the environment of a computer system or other processing system. An example of such a computer system 3100 is shown in FIG. 31. All of the signal processing blocks depicted in FIGS. 2, 3 and 8-12, for example, can execute on one or more distinct computer systems 3100. Furthermore, all of the steps of the flowcharts depicted in FIGS. 13-21 can be implemented on one or more distinct computer systems 3100.

Computer system 3100 includes one or more processors, such as processor 3104. Processor 3104 can be a special purpose or a general purpose digital signal processor. Processor 3104 is connected to a communication infrastructure 3102 (for example, a bus or network). Various software implementations are described in terms of this exemplary computer system. After reading this description, it will become apparent to a person skilled in the relevant art(s) how to implement the invention using other computer systems and/or computer architectures.

Computer system 3100 also includes a main memory 3106, preferably random access memory (RAM), and may also include a secondary memory 3120. Secondary memory 3120 may include, for example, a hard disk drive 3122 and/or a removable storage drive 3124, representing a floppy disk drive, a magnetic tape drive, an optical disk drive, or the like. Removable storage drive 3124 reads from and/or writes to a removable storage unit 3128 in a well known manner. Removable storage unit 3128 represents a floppy disk, magnetic tape, optical disk, or the like, which is read by and written to by removable storage drive 3124. As will be appreciated by persons skilled in the relevant art(s), removable storage unit 3128 includes a computer usable storage medium having stored therein computer software and/or data.

In alternative implementations, secondary memory 3120 may include other similar means for allowing computer programs or other instructions to be loaded into computer system 3100. Such means may include, for example, a removable storage unit 3130 and an interface 3126. Examples of such means may include a program cartridge and cartridge interface (such as that found in video game devices), a removable memory chip (such as an EPROM, or PROM) and associated socket, and other removable storage units 3130 and interfaces 3126 which allow software and data to be transferred from removable storage unit 3130 to computer system 3100.

Computer system 3100 may also include a communications interface 3140. Communications interface 3140 allows software and data to be transferred between computer system 3100 and external devices. Examples of communications interface 3140 may include a modem, a network interface (such as an Ethernet card), a communications port, a PCMCIA slot and card, etc. Software and data transferred via communications interface 3140 are in the form of signals which may be electronic, electromagnetic, optical, or other signals capable of being received by communications interface 3140. These signals are provided to communications interface 3140 via a communications path 3142. Communications path 3142 carries signals and may be implemented using wire or cable, fiber optics, a phone line, a cellular phone link, an RF link and other communications channels.

As used herein, the terms "computer program medium" and "computer usable medium" are used to generally refer to media such as removable storage units 3128 and 3130 or a hard disk installed in hard disk drive 3122. These computer program products are means for providing software to computer system 3100.

Computer programs (also called computer control logic) are stored in main memory 3106 and/or secondary memory 3120. Computer programs may also be received via communications interface 3140. Such computer programs, when executed, enable the computer system 3100 to implement the present invention as discussed herein. In particular, the computer programs, when executed, enable processor 3100 to implement the processes of the present invention, such as any of the methods described herein. Accordingly, such computer programs represent controllers of the computer system 3100. Where the invention is implemented using software, the software may be stored in a computer program product and loaded into computer system 3100 using removable storage drive 3124, interface 3126, or communications interface 3140.

In another embodiment, features of the invention are implemented primarily in hardware using, for example, hardware components such as application-specific integrated circuits (ASICs) and gate arrays. Implementation of a hardware state machine so as to perform the functions described herein will also be apparent to persons skilled in the relevant art(s).

I. Conclusion

While various embodiments of the present invention have been described above, it should be understood that they have been presented by way of example, and not limitation. It will be apparent to persons skilled in the relevant art that various changes in form and detail can be made therein without departing from the spirit and scope of the invention. For example, although embodiments of the present invention are described herein as operating within the context of a telephony terminal, the present invention is not so limited and embodiments of the present invention may be implemented in any device capable of processing an audio signal for playback in the presence of background noise. Furthermore, the processing of an audio signal for playback as described herein may encompass processing the audio signal for immediate playback, processing the audio signal for storage followed by subsequent retrieval and playback, processing the audio signal for playback by the same device on which such processing occurs, or processing the audio signal for transmission to and playback by a different device.

The present invention has been described above with the aid of functional building blocks and method steps illustrating the performance of specified functions and relationships thereof. The boundaries of these functional building blocks and method steps have been arbitrarily defined herein for the convenience of the description. Alternate boundaries can be defined so long as the specified functions and relationships thereof are appropriately performed. Any such alternate boundaries are thus within the scope and spirit of the claimed invention. One skilled in the art will recognize that these functional building blocks can be implemented by discrete components, application specific integrated circuits, processors executing appropriate software and the like or any combination thereof. Thus, the breadth and scope of the present invention should not be limited by any of the above-described exemplary embodiments, but should be defined only in accordance with the following claims and their equivalents.

What is claimed is:

1. A method for processing a portion of a speech signal for playback by an audio device, comprising:

calculating, by one or more processors, a reference amplitude associated with the portion of the speech signal by determining a maximum absolute amplitude of a segment of the speech signal that includes the portion of the speech signal and one or more previously-processed portions of the speech signal;

receiving a first gain to be applied to the portion of the speech signal;

applying compression to the portion of the speech signal if application of the first gain to the portion of the speech signal would cause the reference amplitude associated with the portion of the speech signal to exceed a predetermined amplitude limit; and playing back the portion of the speech signal by the audio device.

2. The method of claim 1, wherein calculating the reference amplitude associated with the portion of the speech signal comprises:

setting the reference amplitude equal to the greater of the maximum absolute amplitude associated with the portion of the speech signal and a product of a reference amplitude associated with a previously-processed portion of the speech signal and a decay factor.

3. The method of claim 1, wherein the predetermined amplitude limit comprises a maximum digital amplitude that can be used to represent the speech signal.

4. The method of claim 1, wherein the predetermined amplitude limit comprises an amplitude that is a predetermined number of decibels above or below a maximum digital amplitude that can be used to represent the speech signal.

5. The method of claim 1, further comprising:

adaptively calculating the predetermined amplitude limit.

6. The method of claim 5, wherein adaptively calculating the predetermined amplitude limit comprises adaptively calculating the predetermined amplitude limit based at least on a user-selected volume.

7. The method of claim 1, wherein applying compression to the portion of the speech signal comprises:

applying a second gain to the portion of the speech signal that is less than the first gain, wherein the second gain is calculated as an amount of gain required to bring the reference amplitude associated with the portion of the speech signal to the predetermined amplitude limit.

8. The method of claim 7, further comprising calculating the second gain in accordance with $$G_{headroom} = 20 \cdot \log_{10}\left(\frac{MAXAMPL}{mx(k)}\right) - G_{margin} - C_p$$

wherein $G_{headroom}$ is the second gain, MAXAMPL is a maximum digital amplitude that can be used to represent the speech signal, mx(k) is the reference amplitude associated with the portion of the speech signal, $G_{margin}$ is a predefined margin and $C_p$ is a predetermined number of decibels.

9. The method of claim 7, further comprising:

calculating a value representative of an amount of compression applied to the portion of the speech signal; and applying spectral shaping to at least one subsequently-received portion of the speech signal wherein the degree of spectral shaping applied is controlled at least in part by the calculated value.

10. The method of claim 9, wherein calculating the value representative of the amount of compression applied to the portion of the speech signal comprises:

calculating an instantaneous volume loss by determining a difference between the first gain and the second gain; and calculating an average version of the instantaneous volume loss to generate the value representative of the amount of compression applied to the portion of the speech signal.

11. The method of claim 7, further comprising:

calculating a value representative of an amount of compression applied to the portion of the speech signal; and performing dispersion filtering on at least one subsequently-received portion of the speech signal wherein the degree of dispersion applied by the dispersion filtering is controlled at least in part by the calculated value.

12. The method of claim 11, wherein calculating the value representative of the amount of compression applied to the portion of the speech signal comprises:

calculating an instantaneous volume loss by determining a difference between the first gain and the second gain; and calculating an average version of the instantaneous volume loss to generate the value representative of the amount of compression applied to the portion of the speech signal.

13. A system for processing a portion of a speech signal for playback by an audio device, comprising:

a waveform envelope tracker configured to calculate a reference amplitude associated with the portion of the speech signal by determining a maximum absolute amplitude of a segment of the speech signal that includes the portion of the speech signal and one or more previously-processed portions of the speech signal; and compression logic configured to receive a first gain to be applied to the portion of the speech signal and to apply compression to the portion of the speech signal if application of the first gain to the portion of the speech signal would cause the reference amplitude associated with the portion of the speech signal to exceed a predetermined amplitude limit; and the audio device configured to play back the portion of the speech signal.

14. The system of claim 13, wherein the waveform envelope tracker is configured to calculate the reference amplitude associated with the portion of the speech signal by setting the reference amplitude equal to the greater of the maximum absolute amplitude associated with the portion of the speech signal and a product of a reference amplitude associated with a previously-processed portion of the speech signal and a decay factor.

15. The system of claim 13, wherein the predetermined amplitude limit comprises a maximum digital amplitude that can be used to represent the speech signal.

16. The system of claim 13, wherein the predetermined amplitude limit comprises an amplitude that is a predetermined number of decibels above or below a maximum digital amplitude that can be used to represent the speech signal.

17. The system of claim 13, wherein the compression logic is configured to adaptively calculate the predetermined amplitude limit.

18. The system of claim 17, wherein the compression logic is configured to adaptively calculate the predetermined amplitude limit based on at least a user-selected volume.

19. The system of claim 13, wherein the compression logic is configured to apply compression to the portion of the speech signal by applying a second gain to the portion of the speech signal that is less than the first gain, wherein the second gain is calculated as an amount of gain required to bring the reference amplitude associated with the portion of the speech signal to the predetermined amplitude limit.

20. The system of claim 19, wherein the compression logic is configured to calculate the second gain by calculating $$G_{headroom} = 20 \cdot \log_{10}\left(\frac{MAXAMPL}{mx(k)}\right) - G_{margin} - C_p$$

wherein $G_{headroom}$ is the second gain, MAXAMPL is a maximum digital amplitude that can be used to represent the speech signal, mx(k) is the reference amplitude associated with the portion of the speech signal, $G_{margin}$ is a predefined margin and $C_p$ is a predetermined number of decibels.

21. The system of claim 19, further comprising:

a compression tracker configured to calculate a value representative of an amount of compression applied to the portion of the speech signal by the compression logic; and a spectral shaping block configured to apply spectral shaping to at least one subsequently-received portion of the speech signal wherein the degree of spectral shaping applied is controlled at least in part by the calculated value.

22. The system of claim 21, wherein the compression tracker is configured to calculate an instantaneous volume loss by determining a difference between the first gain and the second gain and to calculate an average version of the instantaneous volume loss to generate the value representative of the amount of compression applied to the portion of the speech signal.

23. The system of claim 19, further comprising:

a compression tracker configured to calculate a value representative of an amount of compression applied to the portion of the speech signal by the compression logic; and a dispersion filter configured to apply dispersion to at least one subsequently-received portion of the speech signal wherein the degree of dispersion applied by the dispersion filter is controlled at least in part by the calculated value.

24. The system of claim 23, wherein the compression tracker is configured to calculate an instantaneous volume loss by determining a difference between the first gain and the second gain and to calculate an average version of the instantaneous volume loss to generate the value representative of the amount of compression applied to the portion of the speech signal.

25. A computer program product comprising a computer-readable memory having computer program logic recorded thereon for enabling a processing unit to process a portion of a speech signal for playback by an audio device, comprising:

first means for enabling the processing unit to calculate a reference amplitude associated with the portion of the speech signal by determining a maximum absolute amplitude of a segment of the speech signal that includes the portion of the speech signal and one or more previously-processed portions of the speech signal;

second means for enabling the processing unit to receive a first gain to be applied to the portion of the speech signal;

third means for enabling the processing unit to apply compression to the portion of the speech signal if application of the first gain to the portion of the speech signal would cause the reference amplitude associated with the portion of the speech signal to exceed a predetermined amplitude limit; and fourth means for enabling the processing unit to play back the portion of the speech signal.

26. The computer program product of claim 25, wherein the first means enables the processing unit to calculate the reference amplitude associated with the portion of the speech signal by setting the reference amplitude equal to the greater of the maximum absolute amplitude associated with the portion of the speech signal and a product of a reference amplitude associated with a previously-processed portion of the speech signal and a decay factor.

27. The computer program product of claim 25, wherein the predetermined amplitude limit comprises a maximum digital amplitude that can be used to represent the speech signal.

28. The computer program product of claim 25, wherein the predetermined amplitude limit comprises an amplitude that is a predetermined number of decibels above or below a maximum digital amplitude that can be used to represent the speech signal.

29. The computer program product of claim 25, wherein the first means enables the processing unit to adaptively calculate the predetermined amplitude limit based at least on a user-selected volume.

* * * * *